US010263310B2

(12) United States Patent
Kildal et al.

(10) Patent No.: US 10,263,310 B2
(45) Date of Patent: Apr. 16, 2019

(54) WAVEGUIDES AND TRANSMISSION LINES IN GAPS BETWEEN PARALLEL CONDUCTING SURFACES

(71) Applicant: GAPWAVES AB, Göteborg (SE)

(72) Inventors: Per-Simon Kildal, Pixbo (SE); Abbas Vosoogh, Göteborg (SE); Farid Hadavy, Göteborg (SE); Stefan Carlsson, Göteborg (SE); Lars-Inge Sjöqvist, Göteborg (SE)

(73) Assignee: GAPWAVES AB, Göteborg (SE)

( * ) Notice: Subject to any disclaimer, the term of this patent is extended or adjusted under 35 U.S.C. 154(b) by 0 days.

(21) Appl. No.: 15/311,128

(22) PCT Filed: Apr. 10, 2015

(86) PCT No.: PCT/EP2015/057842
§ 371 (c)(1),
(2) Date: Nov. 14, 2016

(87) PCT Pub. No.: WO2015/172948
PCT Pub. Date: Nov. 19, 2015

(65) Prior Publication Data

US 2017/0084971 A1 Mar. 23, 2017

(30) Foreign Application Priority Data

May 14, 2014 (EP) ..... 14168282
Jun. 19, 2014 (EP) ..... 14173128
(Continued)

(51) Int. Cl.
*H01P 3/123* (2006.01)
*H01P 1/207* (2006.01)
(Continued)

(52) U.S. Cl.
CPC ..... *H01P 1/207* (2013.01); *H01P 1/2005* (2013.01); *H01P 3/12* (2013.01); *H01P 3/123* (2013.01);
(Continued)

(58) Field of Classification Search
CPC ..... H01P 1/123; H01P 1/207; H01P 3/123
(Continued)

(56) References Cited

U.S. PATENT DOCUMENTS 3,197,843 A 8/1965 Nippert
3,937,618 A 2/1976 Kirkham
(Continued)

FOREIGN PATENT DOCUMENTS

CN 102084538 A 6/2011
WO 9222101 A1 12/1992

OTHER PUBLICATIONS

International Search Report (PCT/ISA/210) dated Nov. 19, 2015, by the European Patent Office as the International Searching Authority for International Application No. PCT/EP2015/057842.
(Continued)

*Primary Examiner* — Stephen E. Jones
(74) *Attorney, Agent, or Firm* — Buchanan Ingersoll & Rooney P.C.

(57) ABSTRACT

A microwave device, such as a waveguide, transmission line, waveguide circuit, transmission line circuit or radio frequency part of an antenna system, is disclosed. The microwave device comprises two conducting layers arranged with a gap there between, and a set of periodically or quasi-periodically arranged protruding elements fixedly connected to at least one of said conducting layers, thereby forming a texture to stop wave propagation in a frequency band of operation in other directions than along intended waveguiding paths, thus forming a so-called gap waveguide.
(Continued)

All protruding elements are connected electrically to each other at their bases at least via the conductive layer on which they are fixedly connected, and some or all of the protruding elements are in conductive or non-conductive contact also with the other conducting layer. A corresponding manufacturing method is also disclosed.

48 Claims, 20 Drawing Sheets

(30) Foreign Application Priority Data

Jul. 10, 2014 (EP) ..... 14176462
Oct. 13, 2014 (WO) ..... PCT/EP2014/071882
Jan. 19, 2015 (WO) ..... PCT/EP2015/050843

(51) Int. Cl.
*H01P 1/20* (2006.01)
*H01P 11/00* (2006.01)
*H01Q 13/02* (2006.01)
*H01Q 13/10* (2006.01)
*H01Q 21/00* (2006.01)
*H01P 3/12* (2006.01)

(52) U.S. Cl.
CPC ..... *H01P 11/002* (2013.01); *H01P 11/007* (2013.01); *H01Q 13/02* (2013.01); *H01Q 13/0283* (2013.01); *H01Q 13/106* (2013.01); *H01Q 21/0031* (2013.01); *H01Q 21/0087* (2013.01)

(58) Field of Classification Search
USPC ..... 333/239, 208, 209, 211
See application file for complete search history.

(56) References Cited

U.S. PATENT DOCUMENTS 6,134,783 A 10/2000 Bargman et al.
7,146,713 B1 12/2006 Ying
2005/0128028 A1* 6/2005 Sanchez ..... H01P 1/2005 333/157
2011/0018657 A1 1/2011 Cheng et al.
2011/0181373 A1 7/2011 Kildal
2011/0187614 A1* 8/2011 Kirino ..... G01S 7/032 343/713

OTHER PUBLICATIONS

Written Opinion (PCT/ISA/237) dated Nov. 19, 2015, by the European Patent Office as the International Searching Authority for International Application No. PCT/EP2015/057842.
Kildal et al., "Design and Experimental Verification of Ridge Gap Waveguide in Bed of Nails for Parallel-Plate Mode Suppression", IET Microwaves Antennas & Propagation, vol. 5, Issue 3, pp. 262-270, Feb. 21, 2011, XP006037907.
Hesler, J., "A Photonic Crystal Joint for Metal Waveguides", IEEE MTT-S International Microwave Symposium Digest, pp. 783-786, May 20, 2001, XP001067384.
Razavi et al., "Design of 60GHz Planar Array Antennas Using PCB-Based Microstrip-Ridge Gap Waveguide and SIW", The 8th European Conference on Antennas and Propagation (EUCAP 2014), European Association on Antennas and Propagation, pp. 1825-1828, XP032643143.
Zaman et al., "Gap Waveguide PMC Packaging for Improved Isolation of Circuit Components in High-Frequency Microwave Modules", IEEE Transactions on Components, Packaging and Manufacturing Technology, vol. 4, No. 1, pp. 16-25, Jan. 1, 2014, XP011536233.
Kirino H. et al."A 76 GHz Multi-Layered Phased Array Antenna Using a Non-Metal Contact Metamaterial Waveguide" IEEE Transactions on Antennas and Propagation, vol. 60. No. 2. Feb. 2012, (14 pages).
Office Action dated Sep. 30, 2018, by the State Intellectual Property Office of the People's Republic of China in corresponding Chinese Patent Application No. 201580024099.1, (22 pages).
Bozzi, M. et al."Broadband and compact ridge substrate-integrated waveguides" ET Microw. Antennas Propag., vol. 4, iss. 11, 2010, pp. 1965-1973.
Office Action (Communication pursuant to Article 94(3) EPC) dated Jun. 22, 2018, by the European Patent Office in corresponding European Application No. 15 716 030.0-1205, 10 pages.

* cited by examiner

WAVEGUIDES AND TRANSMISSION LINES IN GAPS BETWEEN PARALLEL CONDUCTING SURFACES

FIELD OF THE INVENTION

The present invention relates to a new type of microwave devices, and in particular technology used to design, integrate and package the radio frequency (RF) part of an antenna system, for use in communication, radar or sensor applications, and e.g. components such as waveguide couplers, diplexers, filters, antennas, integrated circuit packages and the like.

The invention relates mainly to frequencies above 30 GHz, i.e. the millimetre wave region, and even above 300 GHz, i.e. submillimeter waves, but the invention may also be advantageous at lower frequencies than 30 GHz.

BACKGROUND

Electronic circuits are today used in almost all products, and in particular in products related to transfer of information. Such transfer of information can be done along wires and cables at low frequencies (e.g. wire-bound telephony), or wireless through air at higher frequencies using radio waves both for reception of e.g. broadcasted audio and TV, and for two-way communication such as in mobile telephony. In the latter high frequency cases both high and low frequency transmission lines and circuits are used to realize the needed hardware. The high frequency components are used to transmit and receive the radio waves, whereas the low frequency circuits are used for modulating the sound or video information on the radio waves, and for the corresponding demodulation. Thus, both low and high frequency circuits are needed. The present invention relates to a new technology for realizing high frequency components such as transmitter circuits, receiver circuits, filters, matching networks, power dividers and combiners, couplers, antennas and so on.

The first radio transmissions took place at rather low frequency below 100 MHz, whereas nowadays the radio spectrum (also called electromagnetic spectrum) is used commercially up to 40 GHz and above. The reason for the interest in exploring higher frequencies is the large bandwidths available. When wireless communication is spread to more and more users and made available for more and more services, new frequency bands must be allocated to give room for all the traffic. The main requirement is for data communication, i.e. transfer of large amounts of data in as short time as possible.

There exist already transmission lines for light waves in the form of optical fibers that can be buried down and represents an alternative to radio waves when large bandwidth is needed. However, such optical fibers also require electronic circuits connected at either end. There may even be needed electronic circuits for bandwidths above 40 GHz to enable use of the enormous available bandwidths of the optical transmission lines. The present invention relates to gap wave technology (see below), which has been found to have excellent properties, such as low losses, and which is very suitable for mass production.

Further, there is a need for technologies for fast wireless communication in particular at 60 GHz and above, involving high gain antennas, intended for consumer market, so low-cost manufacturability is a must. The consumer market prefers flat antennas, and these can only be realized as flat planar arrays, and the wide bandwidth of these systems require corporate distribution network. This is a completely branched network of lines and power dividers that feed each element of the array with the same phase and amplitude to achieve maximum gain.

A common type of flat antennas is based on a microstrip antenna technology realized on printed circuits boards (PCB). The PCB technology is well suited for mass production of such compact lightweight corporate-fed antenna arrays, in particular because the components of the corporate distribution network can be miniaturized to fit on one PCB layer together with the microstrip antenna elements. However, such microstrip networks suffer from large losses in both dielectric and conductive parts. The dielectric losses do not depend on the miniaturization, but the conductive losses are very high due to the miniaturization. Unfortunately, the microstrip lines can only be made wider by increasing substrate thickness, and then the microstrip network starts to radiate, and surface waves starts to propagate, both destroying performance severely.

There is one known PCB-based technology that have low conductive losses and no problems with surface waves and radiation. This is referred to by either of the two names substrate-integrated waveguide (SIW), or post-wall waveguide as in [1]. We will herein use the term SIW only. However, the SIW technology still has significant dielectric losses, and low loss dielectric materials are very expensive and soft, and therefore not suitable for low-cost mass production. Therefore, there is a need for better technologies.

Thus, there is a need for a flat antenna system for high frequencies, such as at or above 60 GHz, and with reduced dielectric losses and problems with radiation and surface waves. In particular, there is a need for a PCB based technology for realizing corporate distribution networks at 60 GHz or above that do not suffer from dielectric losses and problems with radiation and surface waves.

The gap waveguide technology is based on Prof. Kildal's invention from 2008 & 2009 [2], also described in the introductory paper [3] and validated experimentally in [4]. This patent application as well as the paper [5] describes several types of gap waveguides that can replace microstrip technology, coplanar waveguides, and normal rectangular waveguides in high frequency circuits and antennas.

The gap waveguides are formed between parallel metal plates. The wave propagation is controlled by means of a texture in one or both of the plates. Waves between the parallel plates are prohibited from propagating in directions where the texture is periodic or quasi-periodic (being characterized by a stopband), and it is enhanced in directions where the texture is smooth like along grooves, ridges and metal strips. These grooves, ridges and metal strips form gap waveguides of three different types: groove, ridge and microstrip gap waveguides [6], as described also in the original patent application [2].

The texture can be a periodic or quasi-periodic collection of metal posts or pins on a flat metal surface, or of metal patches on a substrate with metalized via-holes connecting them to the ground plane, as proposed in [7] and also described in the original patent application [2]. The patches with via-holes are commonly referred to as mushrooms.

A suspended (also called inverted) microstrip gap waveguide was presented in [8] and is also inherent in the descriptions in [6] and [7]. This consists of a metal strip that is etched on and suspended by a PCB substrate resting on top of a surface with a regular texture of metal pins. This substrate has no ground plane. The propagating quasi-TEM wave-mode is formed between the metal strip and the upper smooth metal plate, thereby forming a suspended microstrip gap waveguide.

This waveguide can have low dielectric and conductive losses, but it is not compatible with normal PCB technology. The textured pin surface could be realized by mushrooms on a PCB, but this then becomes one of two PCB layers to realize the microstrip network, whereby it would be much more costly to produce than gap waveguides realized only using one PCB layer. Also, there are many problems with this technology: It is difficult to find a good wideband way of connecting transmission lines to it from underneath.

The microstrip gap waveguide with a stopband-texture made of mushrooms were in [9] realized on a single PCB. This PCB-type gap waveguide is called a microstrip-ridge gap waveguide, because the metal strip must have via-holes in the same way as the mushrooms.

A quasi-planar inverted microstrip gap waveguide antenna is described in [10]- [12]. It is expensive both to manufacture the periodic pin array under the microstrip feed network on the substrate located directly upon the pin surface, and the radiating elements which in this case were compact horn antennas.

A small planar array of 4×4 slots were presented in [13]. The antenna was realized as two PCBs, an upper one with the radiating slots realized as an array of 2×2 subarrays, each consisting of 2×2 slots that are backed by an SIW cavity. Each of the 4 SIW cavities was excited by a coupling slot fed by a microstrip-ridge gap waveguide in the surface of a lower PCB located with an air gap below the upper radiating PCB. It was very expensive to realize the PCBs with sufficient tolerances, and in particular to keep the air gap with constant height. The microstrip-ridge gap waveguide also requires an enormous amount of thin metalized via holes that are very expensive to manufacture. In particular, the drilling is expensive.

There is therefore a need for new microwave devices, and in particular waveguide and RF packaging technology, that have good performance and in addition is cost-efficient to produce.

SUMMARY OF THE INVENTION

It is therefore an object of the present invention to alleviate the above-discussed problems, and specifically to provide a new microwave device, such as a waveguide or RF part, and RF packaging technology, which has good performance and which is cost-efficient to produce, in particular for use above 30 GHz, and e.g. for use in an antenna system for use in communication, radar or sensor applications.

According to a first aspect of the invention there is provided a microwave device, such as a waveguide, transmission line, waveguide circuit, transmission line circuit or radio frequency (RF) part of an antenna system, the microwave device comprising two conducting layers arranged with a gap there between, and a set of periodically or quasi-periodically arranged protruding elements fixedly connected to at least one of said conducting layers, thereby forming a texture to stop wave propagation in a frequency band of operation in other directions than along intended waveguiding paths, all protruding elements being connected electrically to each other at their bases at least via said conductive layer on which they are fixedly connected, and wherein some or all of the protruding elements are in conductive or non-conductive contact also with the other conducting layer.

The protruding elements are preferably arranged in a periodic or quasi-periodic pattern in the textured surface, and are designed to stop waves from propagating between the two metal surfaces, in other directions than along the waveguiding structure. The frequency band of this forbidden propagation is called the stopband, and this defines the maximum available operational bandwidth of the gap waveguide.

In the context of the present application, the term "microwave device" is used to denominate any type of device and structure capable of transmitting, transferring, guiding and controlling the propagation of electromagnetic waves, particularly at high frequencies where the dimensions of the device or its mechanical details are of the same order of magnitude as the wavelength, such as waveguides, transmission lines, waveguide circuits or transmission line circuits. In the following, the present invention will be discussed in relation to various embodiments, such as waveguides, transmission lines, waveguide circuits or transmission line circuits. However, it is to be appreciated by someone skilled in the art that specific advantageous features and advantages discussed in relation to any of these embodiments are also applicable to the other embodiments.

By RF part is in the context of the present application meant a part of an antenna system used in the radio frequency transmitting and/or receiving sections of the antenna system, sections which are commonly referred to as the front end or RF front end of the antenna system. The RF part may be a separate part/device connected to other components of the antenna system, or may form an integrated part of the antenna system or other parts of the antenna system. The waveguide and RF packaging technology of the present invention are in particular suitable for realizing a wideband and efficient flat planar array antenna. However, it may also be used for other parts of the antenna system, such as waveguides, filters, integrated circuit packaging and the like, and in particular for integration and RF packaging of such parts into a complete RF front-end or antenna system. In particular, the present invention is suitable for realization of RF parts being or comprising gap waveguides.

In previously described gap waveguides, the waves propagate mainly in the air gap between two conducting layers, where at least one is provided with a surface texture, here being formed by the protruding elements. The gap is thereby provided between the protruding elements of one layer and the other conducting layer. Such gap waveguides have very advantageous properties and performance, especially at high frequencies. However, a drawback with the known gap waveguides is that they are relatively cumbersome and costly to produce. In particular, it is complicated to provide the second layer suspended at a more or less constant height over the protruding elements, and at the same time avoid contact between the second layer and the protruding elements.

However, it has now surprisingly been found that the same advantageous waveguide properties and performance as in previous gap waveguides can be achieved even when some of the protruding elements—but not necessarily all of them—are in contact also with the other conducting layer. It has been found that a mechanical connection between the other conducting layer and some arbitrary selection of or all of the protruding elements does not affect the advantageous properties of the microwave device. It has also been found that the properties are not affected even if there is an occasional electrical contact between some of the protruding elements and the conducting layer, or even if there is electrical contact between all the protruding elements and the other conducting layer.

Thus, the microwave device can be manufactured by allowing the other conducting layer to rest on the protruding elements, or even to be connected or fixed to some or all of these protruding elements. This greatly facilitates manufacturing, and also makes the microwave device more robust and easier to adjust and repair afterwards.

It has been found that provision of a well-defined and constant gap between the protruding elements and the overlying conducting layer is complicated and costly to achieve. It is also well known that provision of full electric contact between two surfaces is complicated, and normally requires several well-distributed clamps, bolts or the like. It has now surprisingly been found that provision of some contact between the protruding elements and the overlying conducting layer, such as only mechanical contact but no electric contact or bad electric contact, or even good electric contact, does not affect the electromagnetic perfoimance of the device.

The protruding elements are preferably arranged in at least two parallel rows on both sides along each waveguiding path. However, occasionally, such as along straight passages and the like, and in some particular applications, a single row may suffice. Further, more than two parallel rows may also advantageously be used in many embodiments, such as three, four or more parallel rows.

For example, in one embodiment, the RF part is a waveguide, and wherein the protruding elements are further in contact with, and preferably fixedly connected to, also the other conducting layer, and wherein the protruding elements are arranged to at least partly surround a cavity between said conducting layers, said cavity thereby functioning as a waveguide. Hereby, the protruding elements may be arranged to at least partly provide the walls of a tunnel or a cavity connecting said conducting layers across the gap between them, said tunnel thereby functioning as a waveguide or a waveguide cavity. Thus, in this embodiment, a smooth upper plate (conducting layer) can also rest on the grid array formed by the protruding elements of the other conducting layer, or on some part of it, and the protruding elements/pins that provide the support can e.g. be soldered to the upper smooth metal plate (conducting layer) by baking the construction in an oven. Thereby, it is possible to four post-wall waveguides as described in [1], said documents hereby being incorporated in its entirety by reference, but without any substrate inside the waveguide. Thus, SIW waveguides are provided without the substrate so to say. Such rectangular waveguide technology is advantageous compared to conventional SIW because it reduces the dielectric losses, since there is no substrate inside the waveguide, and the rectangular waveguides can also be produced more cost-effectively, and since the use of expensive lowloss substrate material may now be reduced or even omitted.

At least one of the conductive layers is further preferably provided with at least one conducting element, said conducting element not being in electrical contact with the other of said two conducting layers, said conducting element(s) thereby forming said waveguiding paths, preferably for a single-mode wave. The conducting element(s) is preferably one of a conducting ridge and a groove with conducting walls. Thus, a gap is provided between the other conducting layer, whereas the surrounding protruding elements are in mechanical and possibly also electrical contact with this layer. Here, the gap between a ridge and the overlying conducting layer is preferably in the range of 1-50% of the height of the protruding elements, and preferably in the range of 5-25%, and most preferably in the range of 10-20%. The heights of the protruding elements are typically smaller than quarter wavelength.The gap between the ridge and the overlying conducting layer may in some exemplary embodiments be less than 10 mm, such as less than 5.0 mm, and/or more than 0.5 mm, such as more than 1.0 mm, and e.g. be in the range of 0.5-10 mm, such as in the range 1.0-5.0 mm, such as in the range 2.0-4.0 mm.

The protruding elements in contact with said other conducting layer may be fixedly connected also to this other conducting layer. Further, the protruding elements may be arranged to at least partly surround a cavity between said conducting layers, said cavity thereby fanning said groove functioning as a waveguide.

The width of the conducting element, such as a ridge, is typically selected in accordance with the frequency of operation. In some exemplary embodiments, the width can be selected to be less than 6.0 mm, such as less than 4.0 mm, and/or greater than 1.0 mm, such as greater than 2.0 mm, and e.g. in the range 1.0-6.0 mm, such as in the range 2.0-4.0 mm.

The microwave device is preferably a radio frequency (RF) part of an antenna system, e.g. for use in communication, radar or sensor applications.

The protruding elements preferably have maximum cross-sectional dimensions of less than half a wavelength in air at the operating frequency. It is further preferred that the protruding elements in the texture stopping wave propagation are spaced apart by a spacing being smaller than half a wavelength in air at the operating frequency. This means that the separation between any pair of adjacent protruding elements in the texture is smaller than half a wavelength.

The period of adjacent protruding elements in the set of periodically or quasi-periodically arranged protruding elements is preferably smaller that a half wavelength. The period of the the protruding elements is typically selected in accordance with the frequency of operation. In some exemplary embodiments, the period can be selected to be less than 3.0 mm, such as less than 1.0 mm, and/or greater than 0.05 mm, such as greater than 0.1 mm, and e.g. in the range of 0.05-2.0 mm, such as in the range 0.1-1.0 mm.

The protruding elements, or pins, may have any cross-sectional shape, but preferably have a square, rectangular or circular cross-sectional shape. Further, the protruding elements preferably have maximum cross-sectional dimensions of smaller than half a wavelength in air at the operating frequency. Preferably, the maximum dimension is much smaller than this. The maximum cross-sectional/width dimension is the diameter in case of a circular cross-section, or diagonal in case of a square or rectangular cross-section.

Further, each of the protruding elements preferably has a maximum width smaller than their period. The maximum width of the the protruding elements is typically selected in accordance with the frequency of operation. In some exemplary embodiments, the maximum width can be selected to be less than 1.0 mm, such as less than 0.5 mm, and/or greater than 0.05 mm, such as greater than 0.1 mm, and e.g. in the range 0.05-1.0 mm, such as in the range 0.1-0.5 mm It is possible that only a few or a portion of the protruding elements are in mechanical contact with the other conducting layer. However, preferably all of the protruding elements are in mechanical contact with the other conducting layer.

The other conducting layer may simply rest on the protruding ends of the protruding elements. This makes manufacturing very simple, and also facilitates subsequent removal of the other conducting layer, e.g. for maintenance. However, it is also possible to ensure that at least some of said protruding elements are fixedly attached to said other conducting layer, e.g. by means of soldering or adhesion. Such fixed attachment provides a more robust assembly.

Preferably, the protruding elements have essentially identical heights, the maximum height difference between any pair of protruding elements being due to mechanical tolerances. This depends on manufacturing method and frequency of operation, and may cause some protruding elements to be in mechanical and even electrical contact with the overlaying conducting layer, others not. The tolerances should preferably be good enough to ensure that the possibly occurring gap between any protruding element and the overlying conducting layer is kept to a minimum. In some exemplary embodiments, the height difference is less than 0.1 mm, such as less than 0.05 mm, such as less than 0.01 mm, such as less than 0.005 mm. Hereby, it is possible to provide a relatively uniform distribution of mechanical and electrical connection between the protruding elements and the overlying conducting layer.

The two conducting layers may further be connected together for rigidity by a mechanical structure at some distance outside the region with guided waves, where the mechanical structure may be integrally and preferably monolithically formed on at least one of the conducting materials defining one of the conducting layers.

Preferably, at least part of the two conducting layers are mostly planar except for the fine structure provided by the ridges, grooves and texture (i.e. the protruding elements).

The set of periodically or quasi-periodically arranged protruding elements are in one line of embodiments monolithically formed on one of said conducting layers, and preferably monolithically formed by coining, whereby each protruding element is monolithically fixed to the conducting layer, all protruding elements being connected electrically to each other at their bases via said conductive layer on which they are fixedly connected.

Hereby, the protruding elements are all monolithically integrated with the upper or lower conducing layer, and are preferably all in conductive metal contact with the conducing layer and neighboring protruding elements.

The protruding elements are preferably monolithically formed on the conducting layer by coining, in the way discussed below.

The RF part is preferably a gap waveguide, and further comprising at least one ridge along which waves are to propagate, said ridge being arranged on the same conducting layer as the protruding elements, and also being monolithically formed on said conducting layer.

The ridge gap waveguide makes use of a ridge between the pins to guide the waves. Such ridges may also be monolithically formed in the above-discussed manner, by pressing the formable material into recesses in die. Then, this waveguiding ridge structure, which may have the form of a tree if it is used to realize a branched distribution network, can be formed in between the protruding elements, simultaneously.

The microwave device further preferably comprises at least one ridge along which waves are to propagate, said ridge being arranged on the same conducting layer as the protruding elements, and also being monolithically formed on said conducting layer.

In accordance with another line of embodiments, the microwave device comprises a plurality of monolithic waveguide elements, each having a base and protruding fingers extending up from the base, thereby forming said protruding elements, wherein the waveguide elements are conductively connected with one of said conducting layers, and arranged to form a waveguide along this conducting layer.

The conducting layer on which the monolithic waveguide elements are placed can be arranged as a metal plate or the like, but is preferably arranged as a metalized layer on a substrate. The conducting layer is preferably very thin, which is simplified by locating it on a stiff and solid dielectric substrate to improve mechanical performance and lower cost. The waveguide elements preferably comprise flat base plates for formation of groove gap waveguides.

Thus, a gap waveguide is formed, having two conducting layers arranged with a gap there between, and a set of periodically or quasi-periodically arranged protruding fingers connected to at least one of said conducting layers. The monolithic waveguide elements and their protruding fingers are preferably all electrically connected to each other via said conducting layer on which they are connected, thereby forming a texture to stop wave propagation - in a frequency band of operation - in other directions than along intended waveguiding paths.

It has been found by the present inventors that smaller monolithic waveguide elements, each having a base and protruding fingers extending up from the base, can be manufactured quite easily and cost-effectively. Further, placement and connection of the waveguide elements on the first conducting layer/substrate can also be accomplished in a relatively simple and cost-effective way, such as by using pick-and-place technology, or other surface mount technology (SMT) component placement systems. In particular, the present invention makes it possible to provide standardized waveguide elements, and to use such standardized components, solely or at least to a relatively large extent, when producing various types of RF parts.

Pick-and-place processes are per se known, and have been used for production of electronic assemblies. Such processes typically involve supply of the elements to be picked and placed, e.g. on paper or plastic tapes, on trays or the like, and pick up of an element at a time from the supply, e.g. by means of pneumatic suction cups. The suction cups may be attached to a plotter-like device, or other arrangements, to place the picked up elements on a conductive layer that may be located on a dielectric substrate thereby forming a PCB. When placed on the conductive layer, such as a metallized substrate, the element(s) is maintained in place by adhesive solder-paste or the like. When all elements have been placed on the substrate/layer, the assembly is heat treated at an elevated temperature, whereby the solder-paste melts and fixes the placed elements to the substrate/layer. This solder connection is very strong after returning to room temperature.

It has been found by the present inventors that the provision of monolithic waveguide elements having a base and protruding fingers extending up from the base makes it possible to pre-produce components of one or several types, and to assemble the elements by pick-and-place methodology. This is made possible for example by making the base of the monolithic waveguide elements large enough to serve as a suction area to be picked up by pneumatic suction cups.

The protruding fingers may have any desired shape, but are preferably made of essentially uniform width, thickness and height, making the fingers essentially rectangular in shape. However, other forms, such as having rounded or angular tops or sides, etc, are also feasible. The fingers can also be round pins, having a circular cross-section.

The waveguide elements may be provided as standardized components, and can be assembled by surface mount placement technologies, such as by per se known pick-and-place equipment. This makes it possible to provide a large variety of different RF part in a relatively simple, quick and cost-effective manner. Thus, a great flexibility in designing and producing RF parts is obtained. At the same time, the RF parts have lower losses, and better EMC properties, compared to microstrip solutions and the like.

The waveguide elements preferably comprise flat base plates for formation of groove gap waveguides. A flat base plate is particularly well suited to be lifted by a pneumatic suction cup. However, alternatively the waveguide elements may comprise bases provided with protruding ridges, for formation of ridge gap waveguides. In such an alternative, the top surface of the ridge, a flat area between or outside the pin area, or the like may serve as a surface to be lifted by a pneumatic suction cup.

The protruding fingers of all waveguide elements are preferably in conductive/electrical contact with each other via the conductive surface to which they are connected. The waveguide elements preferably comprise conductive surfaces, and wherein the base and all the fingers of each waveguide element are in electric contact with each other. For example, the waveguide elements may be made of metal. Each waveguide element may, e.g., be made of a single sheet of metal, wherein cut-out tongues are bent upwards to form the protruding fingers.

The protruding fingers preferably extend with an angle towards the plane of the base, and preferably extend orthogonally to this plane. However, other directions are also feasible, such as forming an acute or obtuse angle in relation to said plane.

In one embodiment, the waveguide elements comprise bases provided with protruding ridges, for formation of ridge gap waveguides.

The waveguide elements are preferably made of a conducting material, and preferably metal.

Preferably, at least one of the waveguide elements comprises a plurality of protruding elements, here in the form of fingers, arranged on two opposite sides of the base.

At least one of the waveguide elements may also comprise a plurality of fingers arranged along two or more parallel but separate lines along at least one of the edges. Therefore, realizations with two or more lines of protruding fingers on each side of the waveguide are normally more efficient. Thus, realization of the waveguide elements with two or more finger lines arranged along one or several sides enables a more efficient assembly of efficient waveguides on the conducting layer/substrate. However, several waveguide elements may also be combined to form a waveguide channel being provided with protruding fingers in two or more lines along both sides.

Additionally or alternatively, at least one of the waveguide elements may comprise a plurality of fingers arranged along a single line along at least one of the edges.

At least some of the fingers may be bent-up tongues extending from the outer side of the base. The tongues may be extending from the outer perimeter of the base. However, alternatively, at least some of the fingers may be bent-up tongues extending from interior cut-outs within the base.

The waveguide elements are preferably connected to the first conducting layer by means of solder tin. Thus, the first conducting layer may prior to placement of the waveguide elements be provided with a solder-paste or the like, preferably making the layer somewhat adherent, to maintain the placed waveguide elements in place. When placed, the first conducting layer together with the waveguide elements may be heat treated at an elevated temperature, thereby fixedly connecting the waveguide elements to the first conducting layer.

The protruding fingers functions as pins, nails etc, in the same way as in previously known gap waveguides. Many different shapes and geometries of the fingers are feasible. For example, the fingers may have a shape varying over the height, such as being slightly conical, being wider and/or thicker in the middle, e.g. resembling an oval or spherical shape, having a narrower cross-section at the top and/or bottom, etc. However, preferably the fingers have a relatively uniform width and thickness over the entire height. It is further preferred that the protruding height of the fingers is greater than the width and thickness of the fingers, and preferably greater than double the width and thickness. Still further, it is preferred that the width of the fingers is greater than the thickness.

The flat central part of the base plate, when used for forming a waveguide along the base plate, preferably has a width that is greater than the height of the protruding fingers. Preferably, this width is the range of 2-3 times the height of the protruding fingers, such as about 2.5.

Preferably, the waveguide elements comprise at least one of a straight waveguide element, a curved or bent waveguide element, a branched waveguide element and a transition waveguide element. The transition waveguide element may be a transition to connect to a monolithic microwave integrated circuit module (MMIC).

Preferably, the protruding height of the fingers is greater than the width and thickness of the fingers, and preferably greater than double the width and thickness. Further, the width of the fingers is preferably greater than the thickness.

In accordance with yet another line of embodiments, the protruding elements are formed as a surface mount technology grid array, such as a pin grid array, column grid array and/or a ball grid array, wherein each pin is fixed to the conducting layer by soldering, but wherein all protruding elements are connected electrically to each other at their bases via said conductive layer on which they are fixedly connected.

A surface mount technology (SMT) grid array may be arranged in various ways. This grid array may comprise protruding element in the form of short pins (PGA—Pin Grid Array), solder balls (BGA—Ball Grid Array), solder columns or cylinders (CGA—Column Grid Array), etc. The protruding elements, i.e. the balls, pins, columns etc, may have any desired shape. The board/surface on which the protruding elements are mounted or grown can be PCB or any other suitable material. The grid arrays may e.g. be arranged on substrates made by ceramic (CCGA—Ceramic Column Grid Array; CBGA—Ceramic Ball Grid Array; etc).

Reference will in the following mainly be made to PGA and/or BGA. However, it should be acknowledged by the skilled reader that other SMT grid arrays, such as CGA or CCGA may instead be used in the same way.

The present inventors have now found that similar or better performance than in previous gap waveguides can be obtained in a much more cost-effective way by using pin grid array and/or ball grid array technology. Hereby, it is e.g. possible to realize corporate distribution networks at low manufacturing cost and to sufficient accuracy at 60 GHz and higher frequencies.

It has now been realized that such PGA, PPGA, CPGA, BGA, CGA, CCGA, and other similar SMT grid arrays technologies can be used to manufacture the pin/protruding element surfaces of gap waveguides for a very low price compared to conventional milling of metal plates, and also compared to drilling via holes in a dielectric substrate.

The PGAs are traditionally used to provide conductive connections between many ports of a microprocessor (that is located on one PCB) to the corresponding number of ports on another PCB that can be above or below the first PCB. In this case one PCB contains the PGA, and the other PCB contains a corresponding socket with metalized holes fitting to the locations of all pins of the PGA. Then, each pin represents one port of the upper PCB, and each metalized hole represents one port of the lower PCB. Thus, each pin and each socket hole are electrically isolated from each other and represent individual electric ports of the microprocessor on the first PCB.

On the contrary, when PGAs or other SMT grid arrays are used for realizing gap waveguides and RF packaging and the like in accordance with the present invention, the pins/protruding elements are connected electrically with each other via the conducting layer, such as a metal plate or PCB, on which they are mounted. Thus, they are not electrically isolated from each other at the points of fixation to the PCB or metal plate. This is very different from how PGAs normally are used. Previously known PGAs mounted on PCBs ensures that each pin is isolated, i.e. there is no conductive or metal connection between them at their bases. When PGAs are used to form waveguides and the like in accordance with the present invention, there will be conductive metal contact between neighboring pins on the plate at which they are mounted.

Thus, the protruding elements are hereby formed by the same process as pin grid array and/or a ball grid array used to connect and package digital microprocessors to printed circuit boards, wherein each pin is fixed to the conducting layer by soldering, but, contrary to such known applications of PGA/BGA/CGA, all pins are connected electrically to each other at their bases on the conductive layer.

At least one of the conducting layers may be provided with at least one opening, preferably in the form of rectangular slot(s), said opening(s) allowing radiation to be transmitted to and/or received from said microwave device.

The microwave device may further comprise at least one integrated circuit module, such as a monolithic microwave integrated circuit module, arranged between said conducting layers, the texture to stop wave propagation thereby functioning as a means of removing resonances within the package for said integrated circuit module(s). The integrated circuit module(s) is preferably arranged on one of said conducting layer, and wherein protruding elements overlying the integrated circuit(s) are shorter than protruding elements not overlying said integrated circuit(s). In a preferred such embodiment, the at least one integrated circuit is a monolithic microwave integrated circuit (MMIC).

Preferably, the integrated circuit(s) is arranged on a conducting layer not being provided with said protruding elements, and wherein protruding elements overlying the integrated circuit(s) are shorter than protruding elements not overlying said integrated circuit(s). Hereby, the integrated circuit(s) may be somewhat embraced by the protruding elements, thereby providing enhanced shielding and protection. However, the protruding elements are preferably not in contact with the integrated circuit(s), and also preferably not in contact with the conducting layer on which the integrated circuit(s) is arranged.

The microwave device is preferably adapted to form waveguides for frequencies exceeding 20 GHz, and preferably exceeding 30 GHz, and most preferably exceeding 60 GHz.

According to another aspect of the invention there is provided a flat array antenna comprising a corporate distribution network realized by a microwave device as discussed above.

Hereby, similar embodiments and advantages as discussed above are feasible.

Preferably, the corporate distribution network forms a branched tree with power dividers and waveguide lines between them. This may e.g. be realized as gap waveguides as discussed in the foregoing.

The gap waveguide may form the distribution network of an array antenna. The distribution network is preferably fully or partly corporate containing power dividers and transmission lines, realized fully or partly as a gap waveguide, i.e. formed in the gap between one smooth and one textured surface, including either a ridge gap waveguide, groove gap waveguide and/or a microstrip gap waveguide, depending on whether the waveguiding structure in the textured surface is a metal ridge, groove or conducting strip on a thin dielectric substrate. The latter can be an inverted microstrip gap waveguide, or a microstrip-ridge gap waveguide as defined by known technology.

In a distribution network, the waveguiding structure may be formed like a tree to become a branched or corporate distribution network by means of power dividers and lines between them. The pins surrounding the waveguiding groove, ridge or metal strip may be monolithically integrated with the supporting metal plate or metallized substrate by the same production procedure as discussed above.

The antenna may also be an assembly of a plurality of sub-assemblies, in the way already discussed in the forgoing, whereby the total radiating surface of the antenna is formed by the combination of the radiating sub-assembly surfaces of the sub-assemblies. Each such sub-assembly surface may be provided with an array of radiating slot openings, as discussed in the foregoing. The sub-assembly surfaces may e.g. be arranged in a side-by-side arrangement, to form a square or rectangular radiating surface of the assembly. Preferably, one or more elongated slots working as corrugations may further be arranged between the sub-arrays, i.e. between the sub-assembly surfaces, in the E-plane.

The antenna system may further comprise horn shaped elements connected to the openings in the metal surface of the gap waveguide. Such slots are coupling slots that make a coupling to an array of horn-shaped elements which are preferably located side-by-side in an array in the upper metal plate/conducting layer. The diameter of each horn element is preferably larger than one wavelength. An example of such horn array is per se described in [10], said document hereby being incorporated in its entirety by reference.

When several slots are used as radiating elements in the upper plate, the spacing between the slots is preferably smaller than one wavelength in air at the operational frequency.

The slots in the upper plate may also have a spacing larger than one wavelength. Then, the slots are coupling slots, which makes a coupling from the ends of a distribution network arranged in the textured surface to a continuation of this distribution network in a layer above it, that divides the power equally into an array of additional slots that together form a radiating an array of subarray of slots, wherein the spacing between each slot of each subarray preferably is smaller than one wavelength. Hereby, the distribution network may be arranged in several layers, thereby obtaining a very compact assembly. For example, first and second gap waveguide layers may be provided, in the aforementioned way, separated by a conductive layer comprising the coupling slots, each of which make a coupling from each ends of the distribution network on the textured surface to a continuation of this distribution network that divides the power equally into a small array of slots formed in a conducting layer arranged at the upper side of the second gap waveguide, that together form a radiating subarray of the whole array antenna. The spacing between each slot of the subarray is preferably smaller than one wavelength. Alternatively, only one of said waveguide layers may be a gap waveguide layer, whereby the other layer may be arranged by other waveguide technology.

The distribution network is at the feed point preferably connected to the rest of the RF front-end containing duplexer filters to separate the transmitting and receiving frequency bands, and thereafter transmitting and receiving amplifiers and other electronics. The latter are also referred to as converter modules for transmiting and receiving. These parts may be located beside the antenna array on the same surface as the texture forming the distribution network, or below it. A transition is preferably provided from the distribution network to the duplexer filter, and this may be realized with a hole in the ground plane of the lower conducting layer and forming a rectangular waveguide interface on the backside of it. Such rectangular waveguide interface can also be used for measurement purposes.

Like in previously known gap waveguide, the waveguides provided by the present invention guides waves that propagate mainly in the air gap between the conducting layers, and along paths defined by the protruding elements. The cavity formed between the conducting layers and not filled by the protruding elements can also be filled fully or partly by dielectric material. The periodic or quasi-periodic protruding elements in the textured surface are preferably provided on both sides of the waveguiding paths, and are designed to stop waves from propagating between the two metal surfaces, in other directions than along the waveguiding structure. The frequency band of this forbidden propagation is called the stopband, and this defines the maximum available operational bandwidth of the gap waveguide.

The characteristic impedance of the gap waveguide and line may be approximately given approximately $$Z_k=Z_0h/w$$

where $Z_0$ is the wave impedance in air (or in the dielectric filling the gap region), w is the width of the guiding paths, such as the ridges or grooves, and h is the distance between the groove/ridge and the overlying conducting layer. The parameters h and w are preferably selected in such a way that an adequate and suitable characteristic impedance is obtained.

Preferably, the characteristic impedance is in the range 25-200 Ohm, and more preferably in the range 50-100 Ohm, such as close to 50 Ohm or close to 100 Ohm.

According to another aspect of the invention, there is provided a method for producing a microwave device, such as a waveguide, transmission line, waveguide circuit, transmission line circuit or radio frequency (RF) part of an antenna system, the method comprising:

providing a conducting layer having a set of periodically or quasi-periodically arranged protruding elements fixedly connected thereto, all protruding elements being connected electrically to each other at their bases at least via said conductive layer on which they are fixedly connected;

arranging another conducting layer over said conducting layer, thereby enclosing the protruding elements within the gap formed between the conducting layers;

wherein protruding elements form a texture to stop wave propagation in a frequency band of operation in other directions than along intended waveguiding paths, and wherein some or all of the protruding elements are in conductive or non-conductive contact also with the other conducting layer.

Hereby, similar embodiments and advantages as discussed above are feasible.

In one line of embodiments, the step of providing a conducting layer having a set of periodically or quasi-periodically arranged protruding elements fixedly connected thereto comprises:

providing a die being provided with a plurality of recessions forming the negative of the protruding elements;

arranging a foiniable piece of material on the die; and applying a pressure on the formable piece of material, thereby compressing the formable piece of material to conform with the recessions of the die.

As discussed in the foregoing, gap waveguides have already been demonstrated to work and have lower loss than conventional microstrip lines and coplanar waveguides. The present inventors have now found that similar or better performance can be obtained in a much more cost-effective way by forming the protruding elements monolithically on a conducting layer in a process that may be referred to as die forming or coining, and in particular multilayer die forming, in which a formable piece of material, such as aluminium, is pressed towards a die being provided with a plurality of recessions forming the negative of the protruding elements of the RF part, thereby compressing the formable piece of material to conform with the recessions of the die. Hereby, it is e.g. possible to realize corporate distribution networks at low manufacturing cost and to sufficient accuracy at 60 GHz and higher frequencies.

The die may be provided in one layer, comprising the recessions. However, the die may alternatively comprise two or more layers, at least some of which are provided with through-holes, wherein the recessions are formed by stacking the layers on top of each other. Coining or die forming using such multi-layered dies are here referred to as multilayer die forming. In case three, four, five or even more layers are used, each layer, apart from possibly the bottom layer, has through-holes which appear as recessions when the layers are put on top of each other, and at least some of the throughholes of the different layers being in communication with each other.

Coining or die forming is per se previously known, and has been used in other fields for forming metal sheets and the like. Examples of such known methods are found in e.g. U.S. Pat. Nos. 7,146,713, 3,937,618 and 3,197,843. However, the use of a coining or die forming for production of RF parts of the above-discussed type is neither known nor foreseen in the prior art. The use of a multi-layer die and multilayer die forming are also not known.

The recessions in the die can be formed by means of drilling, milling or the like.

It has now been realized that such a coining/die forming process can be used to manufacture the pin/protruding element surfaces of gap waveguides for a very low price compared to conventional milling of metal plates, and also compared to drilling via holes in a dielectric substrate.

The present invention makes production of RF part of the above-discussed type possible in a quick and cost-effective way, both for production of prototypes and test series, and for full-scale production. The same production equipment may be used for production of many different RF parts. For production of different RF parts, only the die need to be replaced, and in case several die layers are used (see below), it is often sufficient only to replace a single die layer, or to rearrange the order of the die layers.

The recessions in the die or a die layer may be obtained by drilling. However, other means for forming the recessions are also feasible, such as milling, etching, laser cutting or the like are also feasible.

The formable piece of material may be referred to as a billet. The billet is preferably formed by material which is softer than the material of the other components, and in particular the die. The billet/formable material may e.g. be a soft metal, such as aluminum, tin or the like, or other materials, such as a plastic material. If a plastic material or other non-conductive or poorly conductive material is used, the material is preferably plated or metalized after forming, e.g. with a thin plating of silver. The die is preferably made of stainless steel, or other hard metal.

The recessions of the die/die layer may be formed in various ways, such as by drilling, milling, etching, laser cut, or the like.

The present invention makes it possible to cost-efficiently produce RF parts having many protruding elements/pins, protruding elements/pins of small diameter, and/or protruding elements/pins having a great height compared to the diameter. This make it particularly suited for forming RF parts for high frequencies.

The depth of the recessions, and the thickness of the die/die layer carrying the recessions (especially when through-holes are used), provide the height of the protruding structure of the manufactured part, such as pins and/or ridges. Hereby, the height of such elements are easily controllable, and may also easily be arranged to vary over the manufactured parts, so that e.g. some pins are higher than other, the pins are higher than a protruding ridge, etc. Through-holes are more cost-effective to manufacture than cavities. Further, recessions of different depths can hereby easily be obtained by locating die-layers with through-holes on top of each other, so that deeper recessions are obtained if two or more die-layers have coinciding hole locations.

By means of the present invention, RF parts of the above-discussed type can be produced in a very quick, energy-efficient and cost-effective way. The forming of the die layer is relatively simple, and the same die layer may be reused many times. Further, the die layer can easily be exchanged, enabling reuse of the rest of the die and production equipment for production of other RF-parts. This makes the production flexible to design changes and the like. The production process is also very controllable, and the produced RF parts have excellent tolerances. Further, the production equipment is relatively inexpensive, and at the same time provides high productivity. Thus, the production method and apparatus is suitable both for low volume prototype production, production of small series of customized parts, and for mass production of large series.

The die is preferably provided with a collar in which the formable piece of material is insertable. The die may comprise a base plate and a collar, the collar being provided as a separate element, loosely arranged on the base plate.

The die may further comprise at least one die layer comprising through-holes forming said recessions. In a preferred embodiment, the die comprises at least two sandwiched die layers comprising through-holes. Hereby, the sandwiched layers may be arranged to provide various heights and/or shapes of the protruding elements. For example, such sandwiched die layers may be used for cost-efficient realization of protruding elements having varying heights, such as areas of protruding elements of different heights, or realization of protruding element having varying width dimensions, such as being conical, having a stepwise decreasing width, or the like. It may also be used to form ridges, stepped transitions, etc. Preferably, the at least one die layer is arranged within the collar.

The recessions are preferably arranged to form a set of periodically or quasi-periodically arranged protruding elements on the RF part.

The die may be provided with a collar in which the formable piece of material is insertable.

The die may further comprise a base plate and a collar, the collar being provided as a separate element, loosely arranged on the base plate.

Preferably, the die further comprises at least one die layer comprising through-holes forming said recessions.

The die preferably comprises at least two sandwiched die layers comprising through-holes.

The at least one die layer may further be arranged within the collar.

In another line of embodiments, the step of providing a conducting layer having a set of periodically or quasi-periodically arranged protruding elements fixedly connected thereto comprises:

providing a first conducting layer, e.g. arranged as a metalized layer on a substrate;

providing a plurality of monolithic waveguide elements, each having a base and protruding fingers extending up from the base; and conductively connecting the waveguide elements with the first conducting layer, and arranged to form a waveguide along the first conducting layer.

The step of conductively connecting the waveguide elements with the first conducting layer is advantageously made by pick-and-place technology. Hereby, a conventional and per se known pick-and-place equipment can be used. Such equipment is commonly used for placement and production of electronic circuits arranged on PCBs. However, it has now been found that the same or similar equipment can also be used very efficiently for production of gap waveguides and similar RF parts. By use of a base in the waveguide elements and/or a ridge of sufficient dimensions, a lifting area is provided which enables the elements to be lifted pneumatically, and the base further provides sufficient stability of the elements in a placed position, prior to soldering.

The step of conductively connecting the waveguide elements with the first conducting layer preferably comprises the sub-steps of:

picking and placing waveguide elements with a vacuum placement system on said first conducting layer, so that the waveguide elements becomes adhered to the first conducting layer; and heating the first conducting layer at an elevated temperature, thereby connecting the waveguide elements to the first conducting layer by means of soldering.

The present inventors have now found that similar or better performance than previously known can be obtained in a much more cost-effective way by using waveguide elements which can be arranged on a first conducting layer, such as a metalized substrate by e.g. surface mount placement technology, such as pick-and-place technology. Hereby, it is e.g. possible to realize corporate distribution networks at low manufacturing cost and to sufficient accuracy at 60 GHz and higher frequencies.

Along another line of embodiments, the step of providing a conducting layer having a set of periodically or quasi-periodically arranged protruding elements fixedly connected thereto comprises:

providing a first conducting layer; and fixedly connecting a set of periodically or quasi-periodically arranged protruding elements to the first conducting layer, wherein said protruding elements are all electrically connected to each other via said conducting layer on which they are fixedly connected, and wherein said protruding elements are formed by surface mount technology grid array, such as a pin grid array, column grid array and/or ball grid array technology.

The step of providing protruding elements on the first conducting layer preferably involves the steps of:

producing a pattern of the layout of the protruding elements and possible waveguide paths on the first conducting layer;

arranging the parts to be connected to the first conducting layer in a jig; and connecting the parts to the first conducting layer.

These and other features and advantages of the present invention will in the following be further clarified with reference to the embodiments described hereinafter. Notably, the invention is in the foregoing described in terms of a terminology implying a transmitting antenna, but naturally the same antenna may also be used for receiving, or both receiving and transmitting electromagnetic waves. The performance of the part of the antenna system that only contains passive components is the same for both transmission and reception, as a result of reciprocity. Thus, any terms used to describe the antenna above should be construed broadly, allowing electromagnetic radiation to be transferred in any or both directions. E.g., the term distribution network should not be construed solely for use in a transmitting antenna, but may also function as a combination network for use in a receiving antenna.

BRIEF DESCRIPTION OF THE DRAWINGS

For exemplifying purposes, the invention will be described in closer detail in the following with reference to embodiments thereof illustrated in the attached drawings, wherein:

FIG. 3*a* is an exploded view of a subarray/sub-assembly of said antenna, FIG. 3*b* is a perspective view of an antenna comprising four such subarrays/sub-assemblies, and FIG. 3*c* is a perspective view of an alternative way of realizing the antenna of FIG. 3*b;*

FIG. 9*a* is a schematic perspective view seen from the side and FIG. 9*b* is a side view;

DETAILED DESCRIPTION

In the following detailed description, preferred embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well-known constructions or functions are not described in detail, so as not to obscure the present invention.

Figure 1:
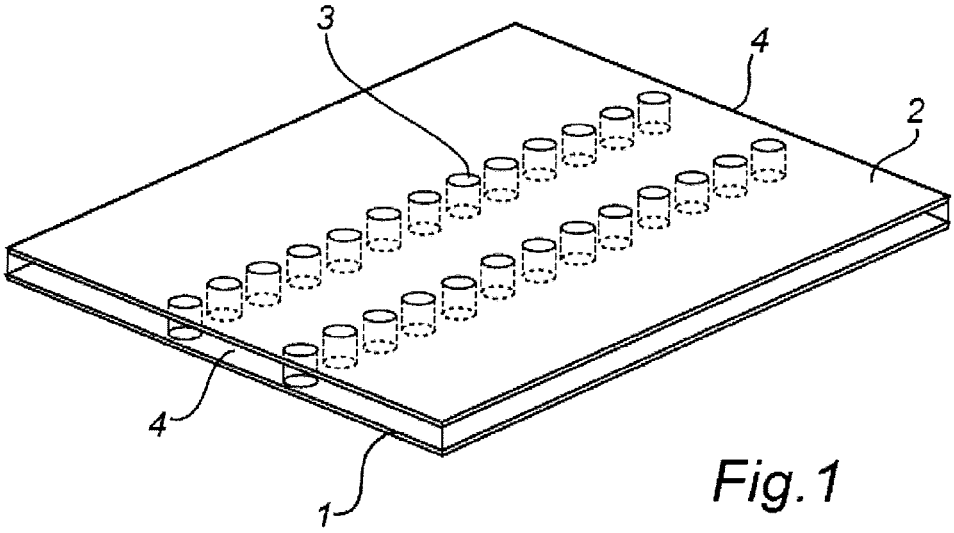
FIG. 1 is a perspective side view showing a gap waveguide in accordance with one embodiment of the present invention.

In a first embodiment, as illustrated in FIG. 1, an example of a rectangular waveguide is illustrated. The waveguide comprises a first conducting layer 1, and a second conducting layer 2 (here made semi-transparent, for increased visibility). The conducting layers are arranged at a constant distance h from each other, thereby forming a gap there between.

This waveguide resembles a conventional SIW with metallized via holes in a PCB with metal layer (ground) on both sides, upper (top) and lower (bottom) ground plane. However, here there is no dielectric substrate between the conducting layers, and the metalized via holes are replaced with a monolithic part comprising a conductive layer and protruding elements 3 extending from, and fixedly monolithically integrated with this first conducting layer. The second conducting layer 2 rest on the protruding elements 3, and is also connected to these, e.g. by means of soldering. The protruding elements 3 are made of conducting material, such as metal. They can also be made of metallized plastics or ceramics.

Further, the first and second conductive layers may be attached to each other by means of a rim, extending around the periphery of one of the conducting layers. The rim is not illustrated, for increased visibility.

Similar to a SIW waveguide, a waveguide is here formed between the conducting elements, here extending between the first and second ports 4.

In this example, a very simple, straight waveguide is illustrated. However, more complicated paths may be realized in the same way, including curves, branches, etc.

Figure 18A:
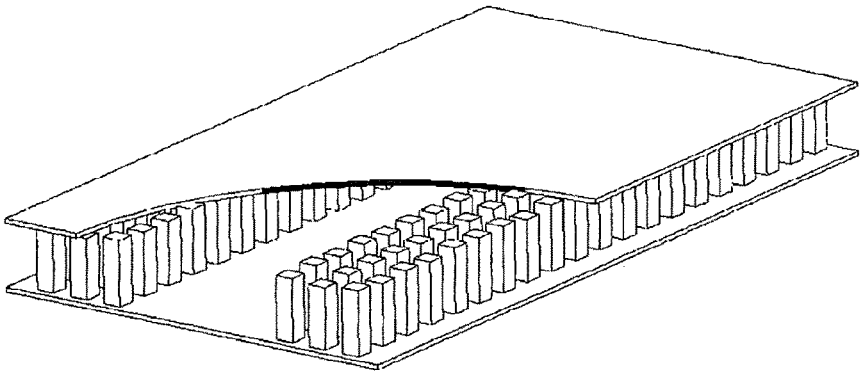
FIG. 18*a* is a perspective side view of a groove gap waveguide in accordance with another embodiment of the present invention.
Figure 18B:
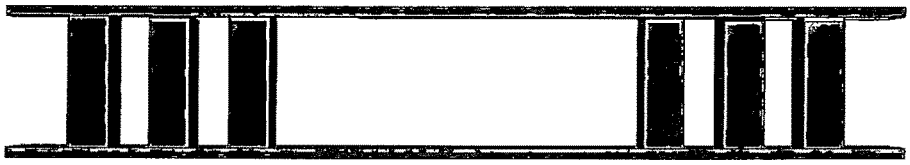
FIG. 18*b* shows a cross-sectional view of the same waveguide.

FIGS. 18*a* and 18*b* illustrate a similar realization of a groove gap waveguide, but instead of having circular protruding elements (as in FIG. 1), the protruding elements are here having a rectangular or square cross-sectional geometry.

Figure 19A:
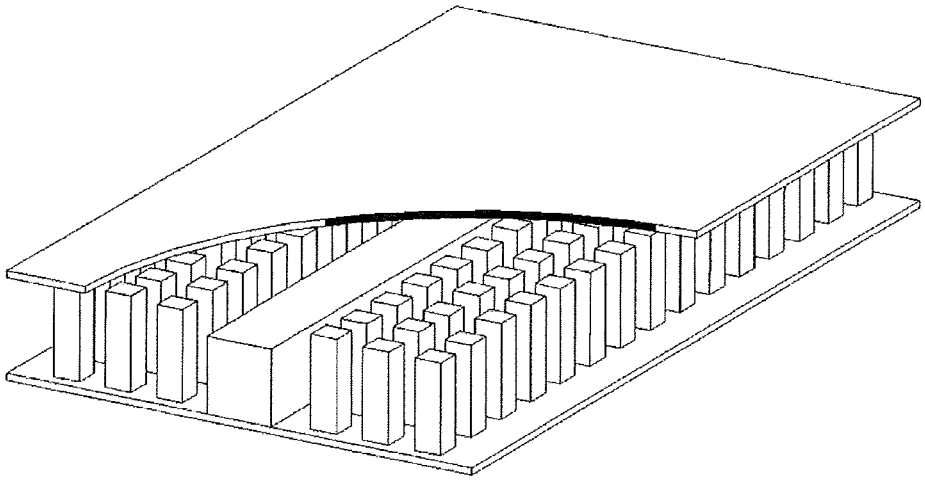
FIG. 19*a* is a perspective side view of a ridge gap waveguide in accordance with another embodiment of the present invention.
Figure 19B:
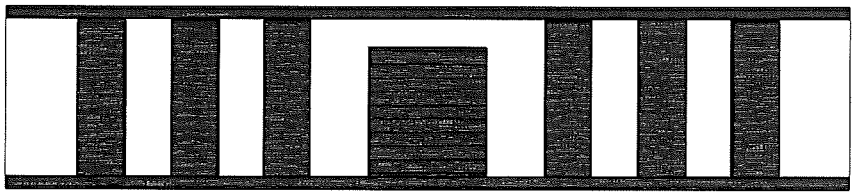
FIG. 19*b* shows a cross-sectional view of the same waveguide.

FIGS. 19*a* and 19*b* illustrate another similar realization, but here the gap waveguide forms a ridge gap waveguide, with a ridge extending from one of the conducting layers, and forming the waveguide path in the waveguide.

Figure 2:
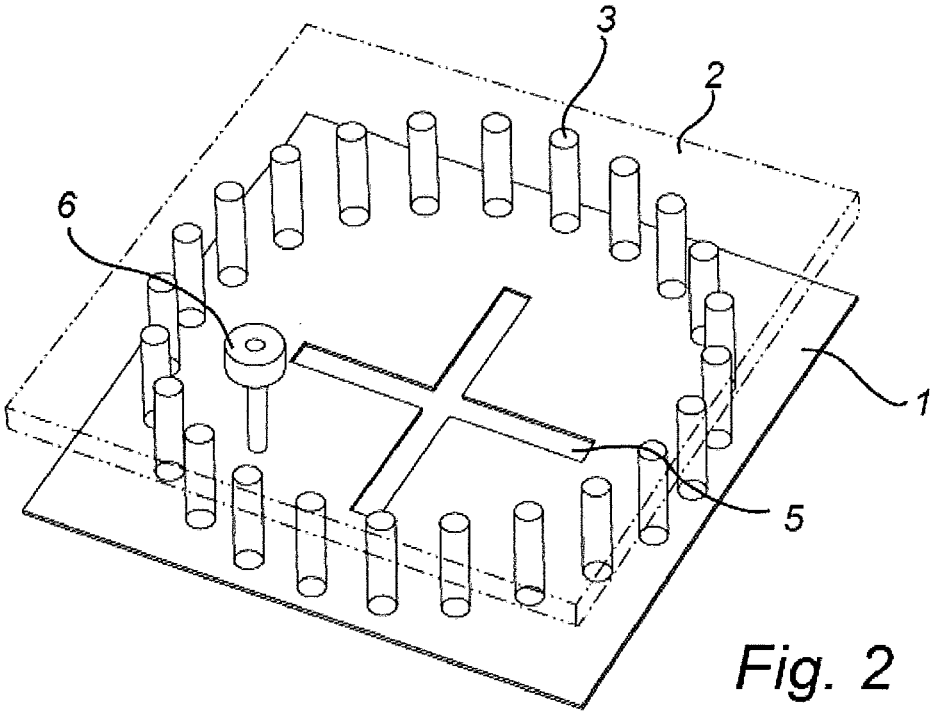
FIG. 2 is a perspective side view showing a circular cavity of a gap waveguide in accordance with another embodiment of the present invention.

FIG. 2 illustrates a circular cavity of a gap waveguide. This is realized in a similar way as in the above-discussed straight waveguide of FIG. 1, and comprises first and second conducting layers 1, 2, arranged with a gap there between, and protruding elements extending between the conducting layers, and connected to these layers. The protruding elements are monolithically connected to one of the conducting layers. The protruding elements 3 are here arranged along a circular path, enclosing a circular cavity. Further, in this exemplary embodiment, a feeding arrangement 6 and an X-shaped radiating slot opening 5 is provided.

This circular waveguide cavity functions in similar ways as circular SIW cavity.

Figure 3A:
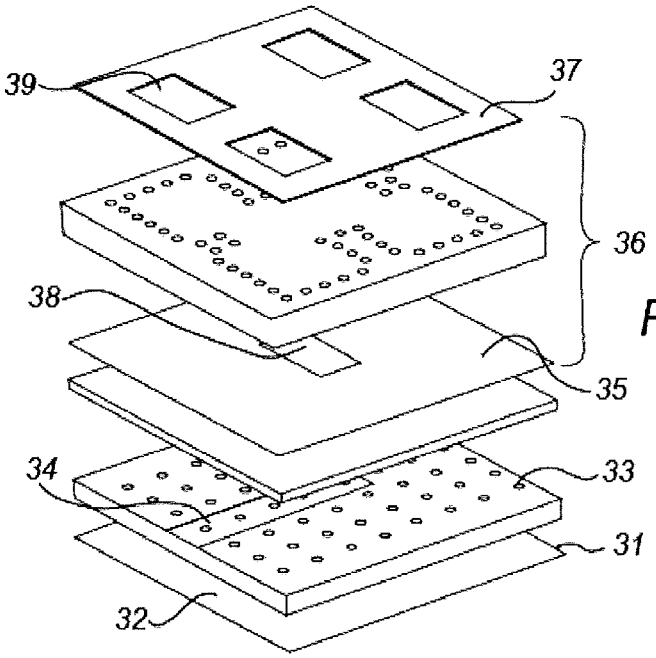
FIGS. 3*a*-3*c* are schematic illustrations of an array antenna in accordance with another embodiment of the present invention, where
Figure 3B:
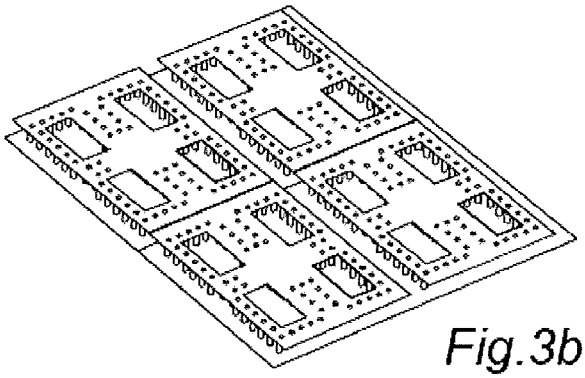
Figure 3C:
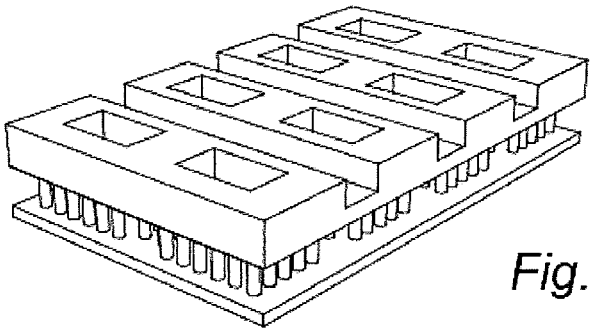

With reference to FIGS. 3*a*-3c, an embodiment of a flat array antenna will now be discussed. This antenna structurally and functionally resembles the antenna discussed in [13], said document hereby being incorporated in its entirety by reference.

FIG. 3*a* shows the multilayer structure of a sub-assembly in an exploded view. The sub-assembly comprises a lower gap waveguide layer 31 with a first ground plane/conducting layer 32, and a texture formed by protruding elements 33 and a ridge structure 34, together forming a gap waveguide between the first ground plane 32 and a second ground plane/conducting layer 35. The second ground plane 35 is here arranged on a second, upper waveguide layer 36, which also comprises a third, upper ground plane/conducting layer 37. The second waveguide layer may also be formed as a gap waveguide layer. A gap is thus formed between both the first and second ground planes and between the second and third ground planes, respectively, thereby forming two layers of waveguides. The bottom, second ground plane 35 of the upper layer has a coupling slot 38, and the upper one has 4 radiating slots 39, and between the two ground planes there is a gap waveguide cavity. FIG. 3*a* shows only a single subarray forming the unit cell (element) of a large array. FIG. 3*b* shows an array of 4 such subarrays, arranged side-by-side in a rectangular configuration. There may be even larger arrays of such subarrays to form a more directive antenna.

Between the subarrays, there is in one direction provided a separation, thereby forming elongated slots in the upper metal plate. Protruding elements/pins are arranged along both sides of the slots. This forms corrugations between the subarrays in E-plane.

In FIG. 3*c*, an alternative embodiment is shown, in which the upper conducting layer, including several sub-arrays, is formed as a continuous metal plate. This metal plate preferably has a thickness sufficient to allow grooves to be formed in it. Hereby, elongate corrugations having similar effects as the slots in FIG. 3*b* can instead be realized as elongate grooves extending between the unit cells.

Either or both of the waveguide layers between the first and second conducting layer and the second and third conducting layer, respectively, may be formed as monolithic gap waveguides as discussed in the foregoing, without any substrate between the two metal ground planes, and with protruding elements extending between the two conducting layers. Then, the conventional via holes, as discussed in [13], will instead be metal pins or the like, which are monolithically formed between the two metal plates, within each unit cell of the whole antenna array.

Figure 4:
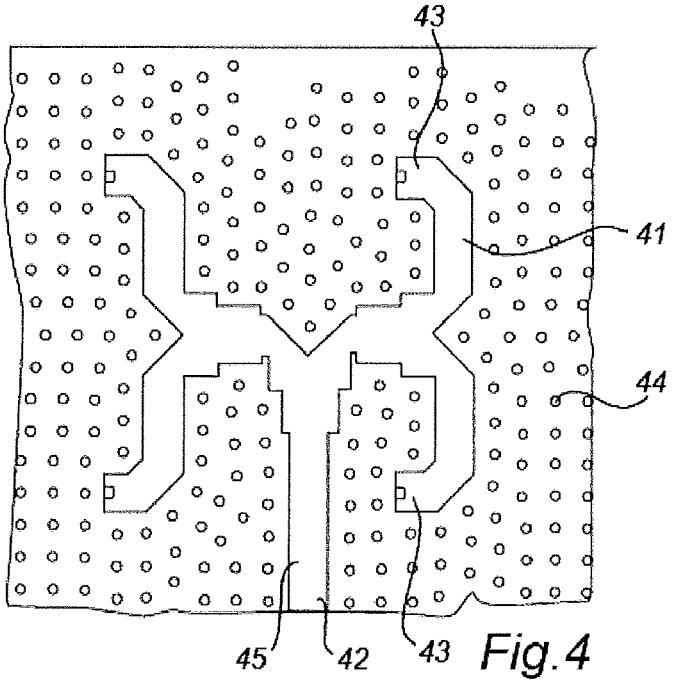
FIG. 4 is a top view of an exemplary distribution network realized in accordance with the present invention, and useable e.g. in the antenna of FIGS. 3*a*-3*c;*

In FIG. 4, a top view of an example of the texture in the lower gap waveguide layer of the antenna in FIG. 3 is illustrated. This shows a distribution network 41 in ridge gap waveguide technology in accordance with [13], for waves in the gap between the two lower conducting layers. The ridge structure forms a branched so-called corporate distribution network from one input port 42 to four output ports 43. The distribution network may be much larger than this with many more output ports to feed a larger array. In contrast to the antenna of [13], the via-holes arranged to provide a stopping texture are here formed as protruding elements 44 monolithically formed in the above-described manner. Hereby, there is no or partly no substrate and the via holes are replaced by the protruding elements/pins. The ridge structure may be formed in the same way, to be monolithically arranged on the conductive layer. Hereby, the ridge becomes a solid ridge such as shown in the ridge gap waveguides in e.g. [4]. Alternatively, the ridge may be drawn as a thin metal strip, a microstrip, supported by pins.

Figure 5:
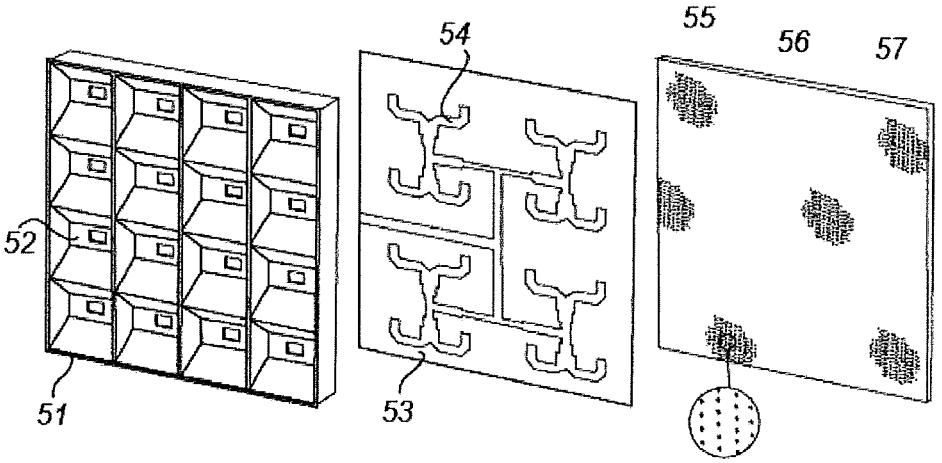
FIG. 5 is a perspective and exploded view of three different layers of an antenna in accordance with another alternative embodiment of the present invention making use of an inverted microstrip gap waveguide.

With reference to FIG. 5, another embodiment of an antenna will now be discussed. This antenna comprises three layers, illustrated separately in an exploded view. The upper layer 51 (left) comprises an array of radiating horn elements 52 formed therein. The middle layer 53 is arranged at a distance from the upper layer 51, so that a gap towards the upper layer is provided. This middle layer 53 comprises a microstrip distribution network 54 arranged on a substrate having no ground plane. The waves propagate in the air gap between the upper and middle layer, and above the microstrip paths. A lower layer 55 (right) is arranged beneath and in contact with the middle layer 53. This lower layer comprises an array of protruding elements 56, such as metal pins, monolithically manufactured in the above-discussed manner on a conducting layer 57. The conducting layer may be formed as a separate metal layer or as a metal surface of an upper ground plane of a PCB. The protruding elements are integrally connected to the conducting layer in such a way that metal contact between the bases of all protruding elements is ensured.

Thus, this antenna functionally and structurally resembles the antenna disclosed in [12], said document hereby being incorporated in its entirety by reference. However, whereas this known antenna was realized by milling to form an inverted microstrip gap waveguide network, the present example provides a distribution network realized as a monolithically formed gap waveguide, which entails many advantages, as has been discussed thoroughly in the foregoing sections of this application.

Figure 6:
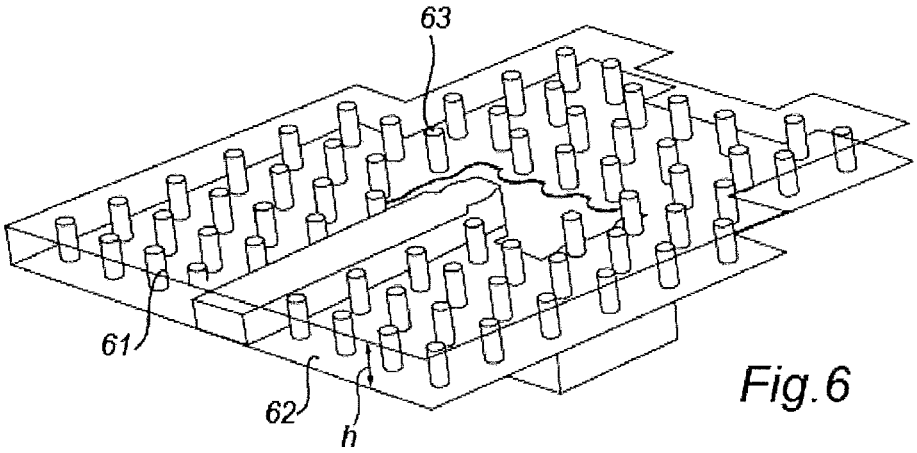
FIG. 6 is a close-up view of an input port of a ridge gap waveguide in accordance with a further embodiment of the present invention.

FIG. 6 provides a close-up view of an input port of a microstrip-ridge gap waveguide on a lower layer showing a transition to a rectangular waveguide through a slot 63 in the ground plane. In this embodiment, there is no dielectric substrate present, and the conventionally used via holes are replaced by protruding elements 61, monolithically connected to a conducting layer 62 in such a way that there is electric contact between all the protruding elements 61. Thus, a microstrip gap waveguide is provided. The upper metal surface is removed for clarity. The microstrip supported by pins, i.e. the micrtostrip-ridge, may also be replaced by a solid ridge in the same way as discussed above in connection with FIG. 4.

Figure 7:
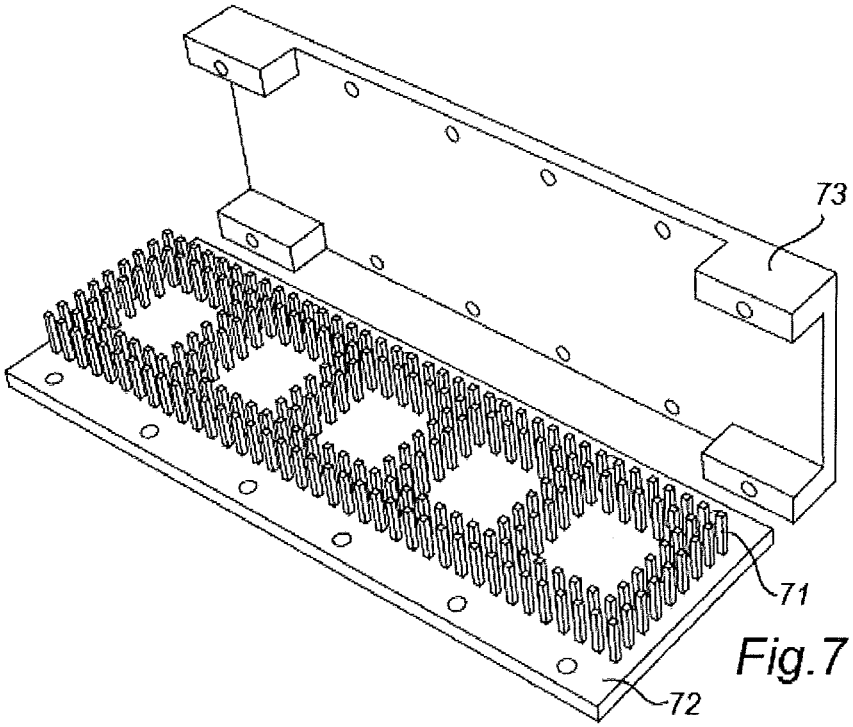
FIGS. 7 and 8 are perspective views of partly disassembled gap waveguide filters in accordance with a further embodiments of the present invention.

FIG. 7 illustrates an exemplary embodiment of a gap waveguide filter, structurally and functionally similar to the one disclosed in [14], said document hereby being incorporated in its entirety by reference. However, contrary to the waveguide filter disclosed in this document, the protruding elements 71 arranged on a lower conducting layer 72 are here formed by monolithically and integrally formed protruding elements in the above-discussed fashion. An upper conducting layer 73 is arranged above the protruding elements, in the same way as disclosed in [12]. Thus, this then becomes a groove gap waveguide filter.

Figure 8:
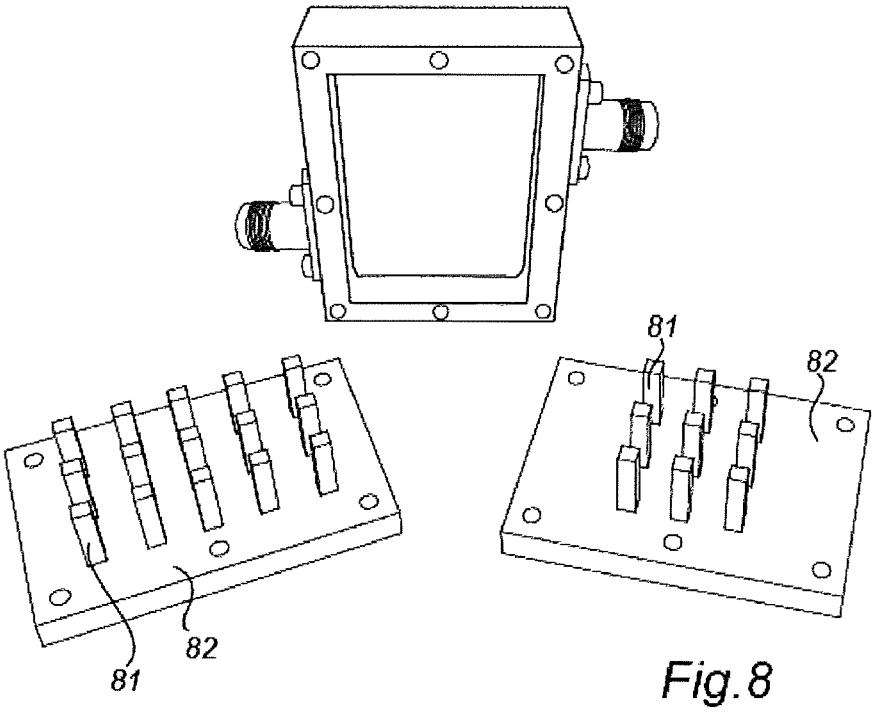

FIG. 8 provides another example of a waveguide filter, which may also be referred to as gap-waveguide-packaged microstrip filter. This filter functionally and structurally resembles the filter disclosed in [15], said document hereby being incorporated in its entirety by reference. However, contrary to the filter disclosed in [15], the filter here is packaged by a surface having protruding elements, in which protruding elements 81 provided on a conducting layer 82 are realized in the above-described way. Two alternative lids, comprising different number and arrangement of the protruding elements 81 are illustrated.

Figure 9A:
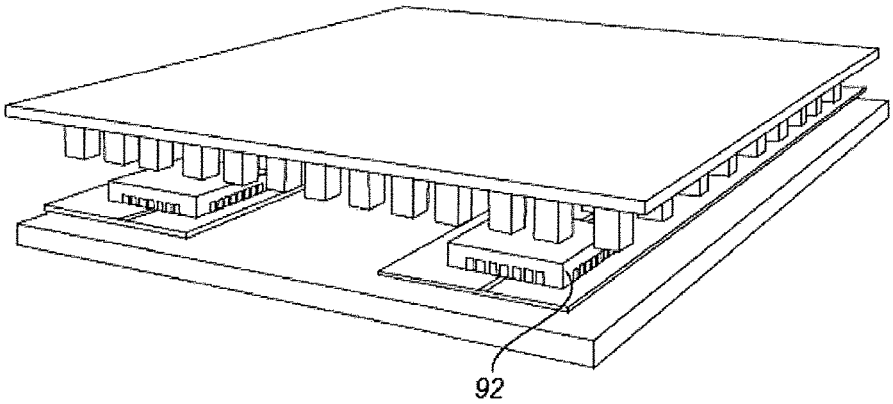
FIGS. 9*a* and 9*b* are illustrations of a gap waveguide packaged MMIC amplifier chains, in accordance with a further embodiment of the present invention, and where
Figure 9B:
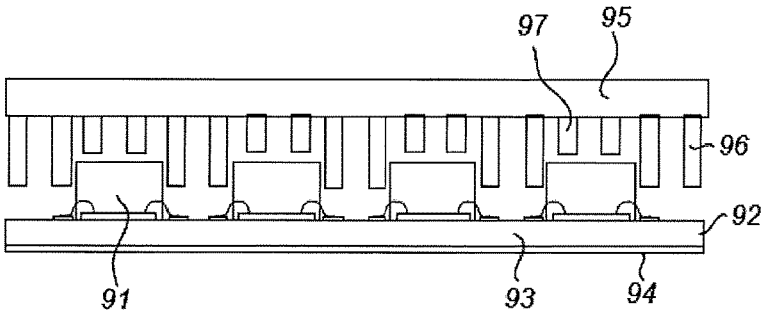

With reference to FIGS. 9*a* and 9*b*, an embodiment providing a package for integrated circuit(s) will be discussed. In this example, the integrated circuits are MMIC amplifier modules 91, arranged in a chain configuration on a lower plate 92, here realized as a PCB having an upper main substrate, provided with a lower ground plane 93. A lid is provided, formed by a conducting layer 95, e.g. made of aluminum or any other suitable metal. The lid may be connected to the lower plate 92 by means of a surrounding frame or the like.

The lid is further provided with protruding elements 96, 97, protruding towards the lower plate 92. This is functionally and structurally similar to the package disclosed in [16], said document hereby being incorporated in its entirety by reference. The protruding elements are preferably of different heights, so that the elements overlying the integrated circuits 91 are of a lower height, and the elements overlying areas laterally outside the integrated circuits are of a greater height. Hereby, holes are formed in the surface presented by the protruding elements, in which the integrated circuits are inserted. The protruding elements are in electric contact with the upper layer 95, and electrically connected to each other by this layer. Further, but not shown in the figures, at least some of the protruding elements may be in contact also with the lower plate 92, and also possibly with the integrated circuit modules 91.

Here, and contrary to the disclosure in [16], the protruding elements are formed on the upper layer 95 monolithically. This packaging is consequently an example of using the gap waveguide as discussed above as a packaging technology, according to the present invention.

The above-discussed exemplary embodiments, such as other realizations of microwave devices in accordance with the invention, can be manufactured and produced in various ways. For example, it is possible to use conventional manufacturing techniques, such as drilling, milling and the like.

However, according to one preferred line of embodiments, the microwave devices, and in particular the protruding elements, are formed by PGA, BGA, or other surface mount technology (SMT) grid arrays, such as CGA and the like.

According to another preferred line of embodiments, the microwave devices may be produced by using a die forming or coining technique to be discussed in more detail in the following, thereby monolithically integrated protruding elements.

According to yet another preferred line of embodiments, the microwave devices are produced by pick-and-place technology, and using standardized or customized waveguide elements. This is also discussed in more detail in the following.

Notably, all of these three preferred techniques may be used not only to form the microwave devices where some or all of the protruding elements are in conductive or non-conductive contact also with the other conducting layer, but may also be used to form and produce conventional gap waveguides and the like, where a gap is provided between the protruding elements and the overlying conducting layer/surface.

An equipment and method for manufacturing of monolithically formed microwave devices and RF parts will next be described in further detail, with reference to FIGS. 10-17.

Figure 10:
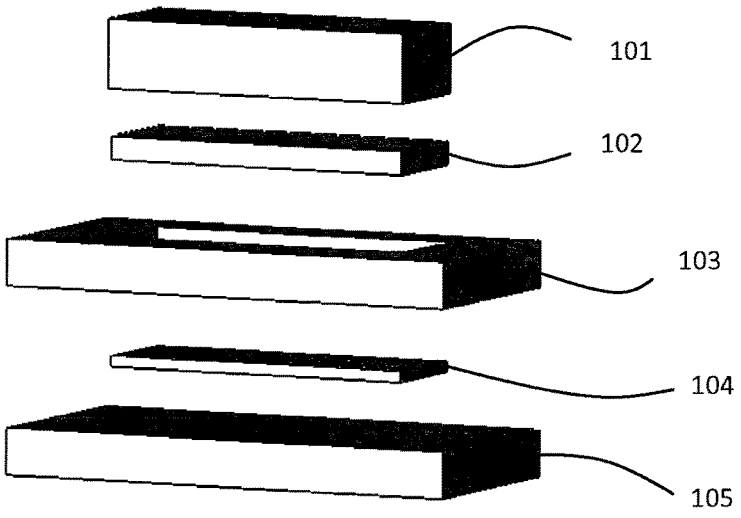
FIG. 10 is a schematic exploded view of a manufacturing equipment in accordance with one embodiment of the present invention.
Figure 11:
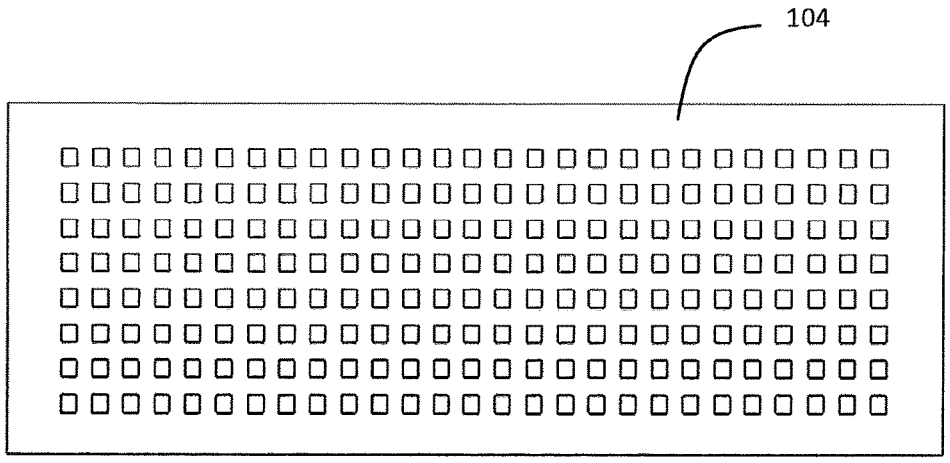
FIG. 11 is a top view of the die forming layer in FIG. 10.

With reference to FIG. 10, a first embodiment of an apparatus for producing an RF part comprises a die comprising a die layer 104 being provided with a plurality of recessions forming the negative of the protruding elements of the RF part. An example of such a die layer 104 is illustrated in FIG. 11. This die layer 104 comprises a grid array of evenly dispersed through-holes, to form a corresponding grid array of protruding elements. The recessions are here of a rectangular shape, but other shapes, such as circular, elliptical, hexagonal or the like, may also be used. Further, the recessions need not have a uniform cross-section over the height of the die layer. The recessions may be cylindrical, but may also be conical, or assume other shapes having varying diameters.

Figure 12:
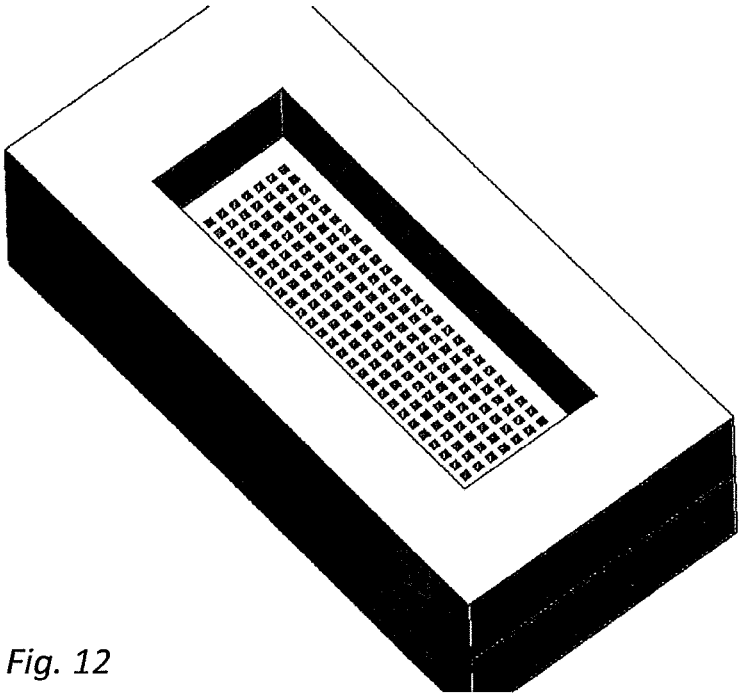
FIG. 12 is a perspective view of the assembled die of FIG. 10.

The die further comprises a collar 103 arranged around said at least one die layer. The collar and die layer are preferably dimensioned to that the die layer has a close fit with the interior of the collar. In FIG. 12, the die layer arranged within the collar is illustrated.

The die further comprises a base plate 105 on which the die layer and the collar are arranged. In case the die comprises through-holes, the base plate will form the bottom of the cavities provided by the through-holes.

Figure 13:
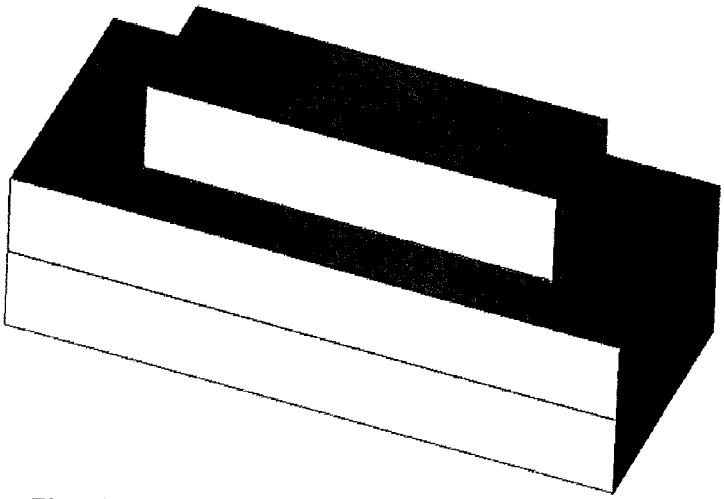
FIG. 13 is a perspective view of the manufacturing equipment of FIG. 10 in an assembled disposition.

A formable piece 102 of material is further arranged within the collar, to be depressed onto the die layer 104. Pressure may be applied directly to the formable piece of material, but preferably, a stamp 101 is arranged on top of the formable piece of material, in order to distribute the pressure evenly. The stamp is preferably also arranged to be insertable into the collar, and having a close fit with the interior of the collar. In FIG. 13, the stamp 101 arranged on top of the formable piece of material in the collar 103 is illustrated in an assembled disposition.

The above-discussed arrangement may be arranged in a conventional pressing arrangement, such as a mechanical or hydraulic press, to apply a pressure on the stamp and the base plate of the die, thereby compressing the formable piece of material to conform with the recessions of the at least one die layer.

The multilayer die press or coining arrangement discussed above can provide protruding elements/pins, ridges and other protruding structures in the formable piece of material having the same height. Through-holes are obtainable e.g. by means of drilling. In case non-through going recessions are used in the die layer, this arrangement may also be used to produce such protruding structures having varying heights.

However, in order to produce protruding structures having varying heights, it is also possible to use several die layers, each having through-holes. Such an embodiment will now be discussed with reference to FIGS. 14-17.

Figure 14:
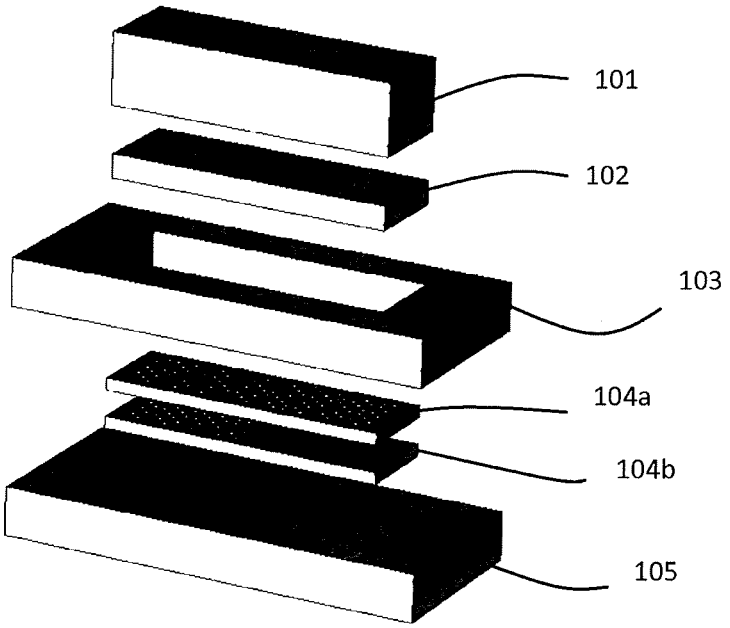
FIG. 14 is a schematic exploded view of a manufacturing equipment in accordance with another embodiment of the present invention.
Figure 15:
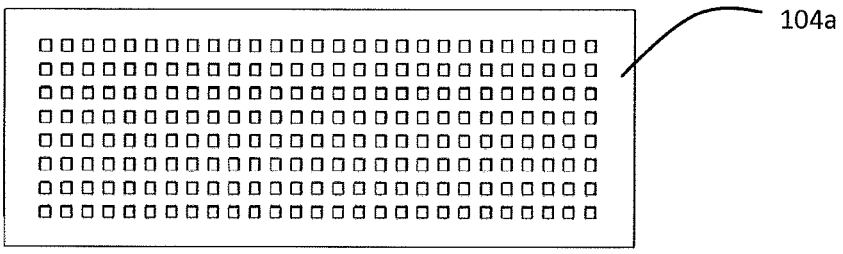
FIGS. 15 and 16 are top views illustrating the two die forming layers in the embodiment of FIG. 14.
Figure 16:
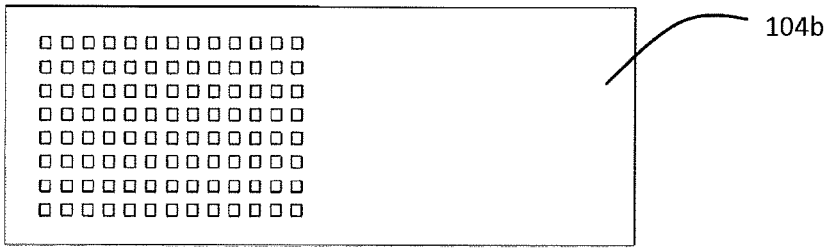
Figure 17:
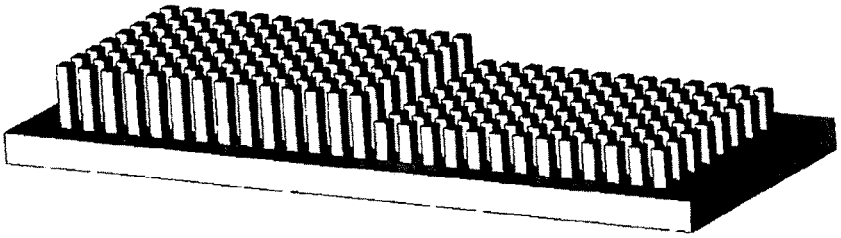
FIG. 17 is a perspective view showing an RF part producible by the manufacturing equipment of FIG. 14.

With reference to the exploded view of FIG. 14, this apparatus comprises the same layers/components as in the previously discussed embodiment. However, here two separate die layers 104*a* and 104*b* are provided. Examples of such die layers are illustrated in FIGS. 15 and 16. The die layer 104*a* (shown in FIG. 15) being arranged closest to the formable piece of material 102 is provided with a plurality of through-holes. The other die layer 104*b* (shown in FIG. 16), being farther from the formable piece of material 102 comprises fewer recessions. The recessions of the second die layer 104*b* are preferably correlated with corresponding recessions in the first die layer 104a. Hereby, some recessions of the first die layer will end at the encounter with the second die layer, to form short protruding elements, whereas some will extend also within the second die layer, to form high protruding elements. Hereby, by adequate formation of the die layer, it is relatively simple to produce protruding element of various heights, An example of an RF part having protruding elements of varying heights, in accordance with the embodiments of the die layers illustrated in FIGS. 15 and 16, is shown in FIG. 17.

In the foregoing, the stamp 101, collar 103, die layer(s) 104 and base plate 105 are exemplified as separate elements, being detachably arranged on top of each other. However, these elements may also be permanently or detachably connected to each other, or formed as integrated units, in various combinations. For example, the base plate 105 and collar 103 may be provided as a combined unit, the die layer may be connected to the collar and/or the base plate, etc.

The pressing in which pressure is applied to form the formable material in conformity with the die layer may be performed at room temperature. However, in order to facilitate the formation, especially when relatively hard materials are used, heat may also be applied to the formable material. For example if aluminum is used as the formable material, the material may be heated to a few hundred degrees C., or even up to 500 deg. C. If tin is used, the material may be heated to 100-150 deg. C. By applying heat, the forming can be faster, and less pressure is needed.

To facilitate removal of the formable material from the die/die layer after the forming, the recessions can be made slightly conical or the like. It is also possible to apply heat or cold to the die and formable material. Since different materials have different coefficients of thermal expansion, the die and formable material will contract and expand differently when cold and or heat is applied. For example, tin has a much lower coefficient of thermal expansion than steel, so if the die is made of steel and the formable material of tin, removal will be much facilitated by cooling. Cooling may e.g. be made by dipping or in other way exposing the die and/or formable material to liquid nitrogen.

The protruding elements/fingers 3 may also be provided in the form of monolithic waveguide elements 106, and these elements will now be discussed more thoroughly.

Each waveguide element comprises a base 161, and fingers 3 protruding from the base, preferably in an essentially orthogonal direction. An example of such a waveguide element is illustrated in the right-hand figure of FIG. 20. Here, the base 161 has an elongate, rectangular form, and protruding fingers are provided at both longitudinal sides. This waveguide element can be produced by punching out a blank in the form of the rectangular centre and tongues extending out from the longitudinal sides, as illustrated in the left-hand figure of FIG. 20. The tongues can then be bent upwards, e.g. by press forming, to the erect position of the right hand figure of FIG. 20.

Figure 20:
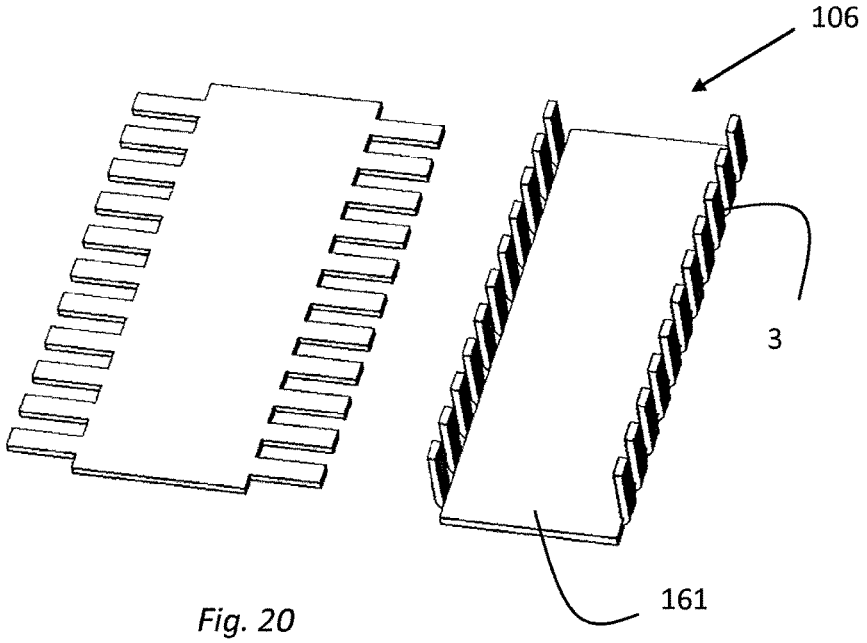
FIG. 20 is a perspective side view showing a waveguide forming element according to a first embodiment, wherein the right hand figure shows the waveguide forming element, and the left hand figure shows a punched out preform for formation of the waveguide element of the right hand figure.
Figure 21:
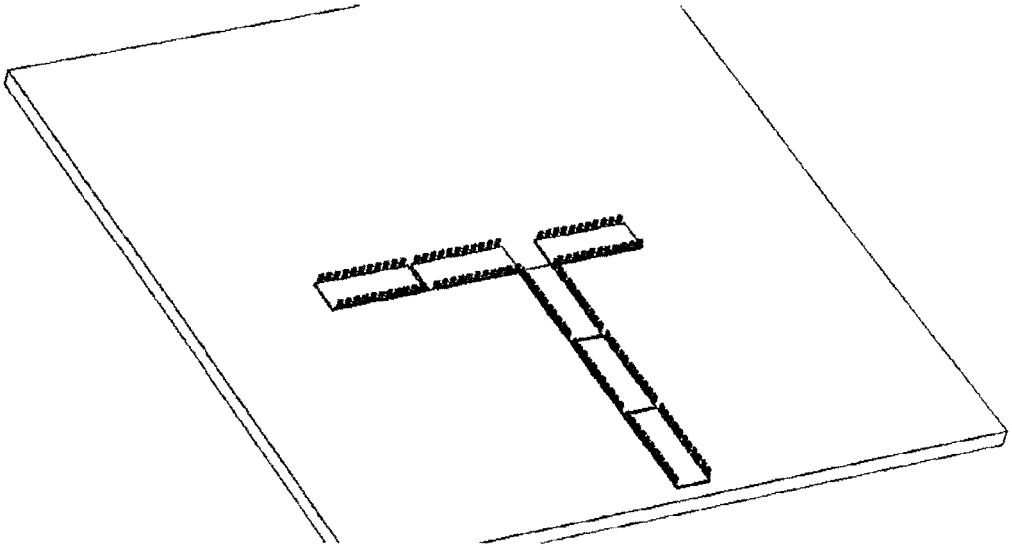
FIG. 21 is a perspective top view of a partly assembled waveguide, made by the waveguide elements of FIG. 20.

These waveguide elements can then be picked and placed on the substrate having a conducting layer, as is schematically illustrated in FIG. 21, where six elements of the type discussed in relation to FIG. 20 have been arranged along a T-path. Picking and placing of such elements can be made by a per se known pick-and-place equipment. Preferably, the waveguide elements are provided on tapes, on trays or the like, and are picked by a pick-up arrangement, e.g. using pneumatic suction cups. The waveguide elements are then placed on the substrate. The substrate preferably has an adherent surface, to maintain the placed waveguide elements in place during assembly. When all waveguide elements have been properly placed, the connection between the waveguide elements and the substrate is fixated. For example, a soldering paste could be arranged on the substrate prior to placement, which is adherent to maintain the placed elements in the right position during assembly, and which fixates the element when the substrate is subsequently heat treated at an elevated temperature, e.g. by applying infrared heating to the substrate, or by treatment in an oven.

The waveguide elements are preferably made of metal, but may also be made of e.g. plastic materials or the like, which are provided with metalized surfaces.

Figure 22:
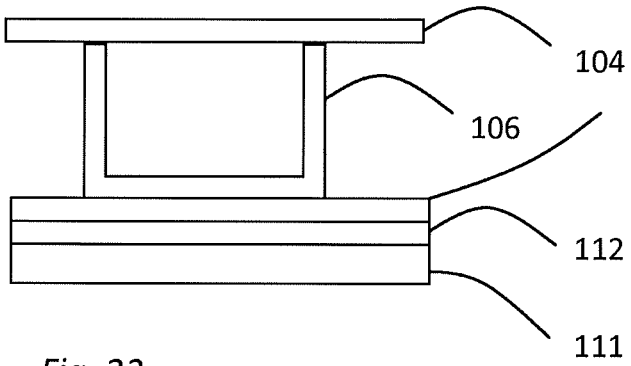
FIG. 22 is a cross-sectional view of the waveguide of FIG. 21.

FIG. 22 schematically illustrates a waveguide formed in this way, in a schematic cross-sectional view. The waveguide comprises a lower substrate, in this example comprising a lower substrate layer 111, an optional conductive metal layer 112 on top of said lower substrate layer and a solder or solder paste layer 113. A waveguide element 106 is arranged on top of the solder or solder paste layer 113, and consequently the waveguide element is in electric and conductive contact with the conductive layer of the substrate, and fixated to the substrate by means of soldering. The lower substrate layer can be made of metal, whereby it will in itself serve as a conductive layer. In this case, the conductive layer 112 can be omitted. On top of the waveguide element, the second conductive layer 104 is arranged, as discussed in the foregoing, in such a way that there is at least partly contact between the protruding elements and the second conductive layers, and so that a gap is formed between the conducting layers enclosing the protruding fingers of the waveguide elements there between.

The waveguide element of FIG. 20 is arranged to provide a straight waveguide section. However, more complex geometries can be provided in essentially the same way. Some examples of such alternative geometries are illustrated in FIGS. 23-26.

Figure 23:
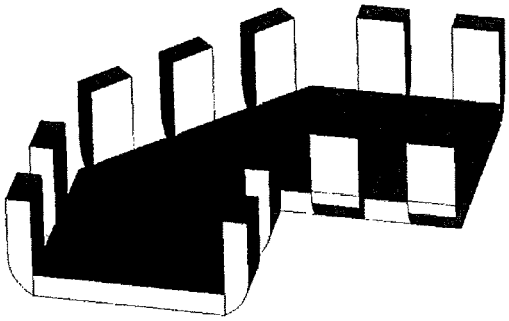
FIGS. 23-26 illustrate waveguide elements of a similar type as in FIG. 20, but having different geometries.

FIG. 23 illustrate a curved waveguide section, in which the base plate forms a curve, and with protruding fingers being provided along the sides.

Figure 24:
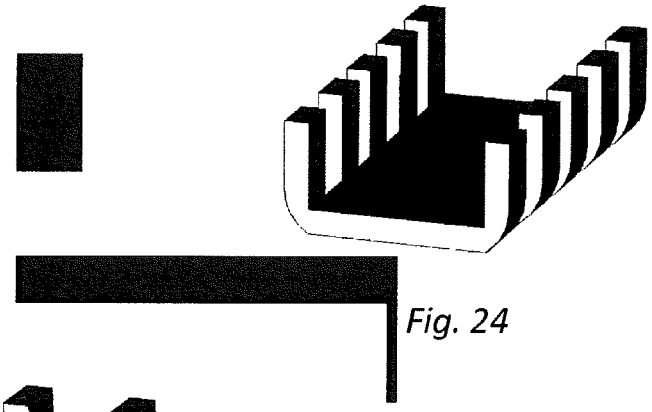

FIG. 24 is a straight waveguide section similar to the one of FIG. 20, but having fewer protruding fingers along the longitudinal sides.

Figure 25:
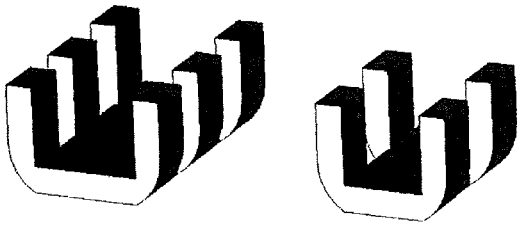

FIG. 25 illustrates even shorter waveguide elements. Such short waveguide elements may comprise four, six or eight protruding fingers each, with 2-4 fingers on each longitudinal side. Such short waveguide elements may be combined in various ways to provide waveguides in the centre, or be arranged along the sides of waveguides, etc. Some examples of this is provided in the following.

Figure 26:
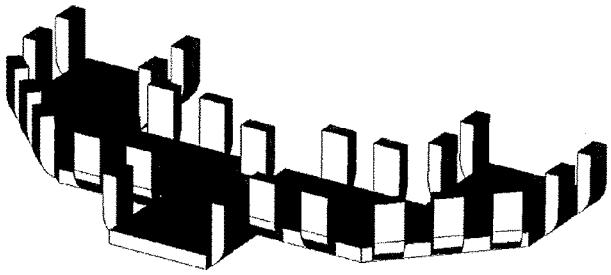

FIG. 26 illustrates a more complex geometry, providing a divider, where one incoming waveguide is split into two outgoing waveguides, or vice versa.

Forming waveguides by use of such waveguide elements can be made in various ways, and some examples are provided in the following, with reference to FIGS. 27-30.

Figure 27:
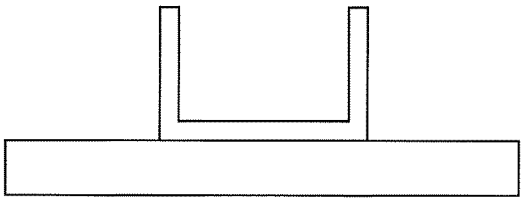
FIGS. 27-30 are schematic cross-sectional views illustrating various ways of using waveguide elements to form different types of waveguides.

In FIG. 27, a waveguide element forms the waveguide along the base plate, with the protruding fingers being arranged on the sides of this waveguide. The waves hereby propagate along the base, and only a single row of protruding fingers is provided at each side. Such embodiments work for some embodiments, in particular if the protruding fingers are in conductive contact with both the first and second conductive layer, but often it is preferred to provide two or more rows of protruding fingers along each side.

Figure 28:
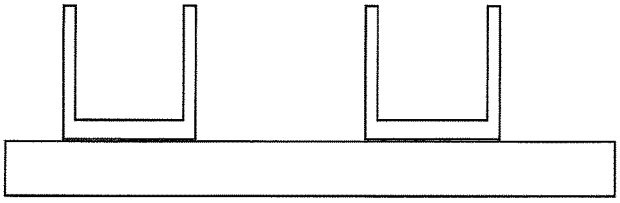

In FIG. 28, two waveguide forming elements are placed parallel to each other, and with a separation distance there between. In this embodiment, the waves propagate along the separation distance, and the waveguide elements forming double rows of protruding fingers along each side.

Figure 29:
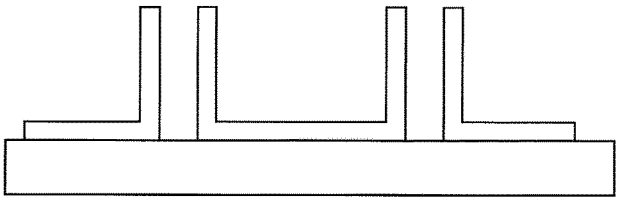
Figure 30:
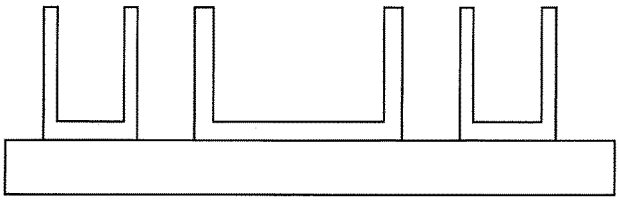

In FIG. 29, a waveguide forming element having protruding fingers along each longitudinal side is used as a waveguide, in a similar way as in the embodiment of FIG. 27. However, in addition, additional waveguide elements having protruding fingers only at one side are arranged parallel with the center waveguide element, thereby providing double rows of protruding fingers along the waveguide. The additional waveguide elements may also have protruding fingers on each side, thereby providing three rows of protruding fingers along each side of the waveguide, as is illustrated in FIG. 30.

However, the waveguide elements may also comprise two or more rows of protruding fingers. Some examples of such waveguide elements are discussed in the following, in relation to FIGS. 31 and 32.

Figure 31:
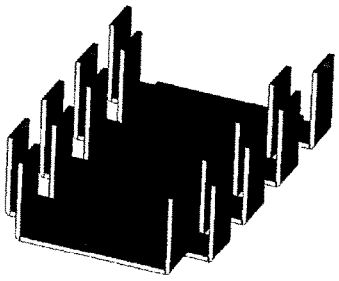
FIGS. 31-32*d* illustrate different embodiments of waveguide elements having two rows of protruding fingers along each side.

In the embodiment of FIG. 31, a waveguide similar to the one discussed in relation to FIG. 20 is provided, with tongues being formed at the edge of the base. However, in this embodiment, the tongues are bent upwards along two different folding lines at each side, so that every other tongue is situated farther away from the centre line of the waveguide element. Hereby, two rows of staggered protruding fingers are obtained.

Figure 32A:
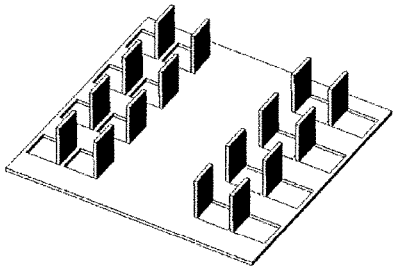
Figure 32C:
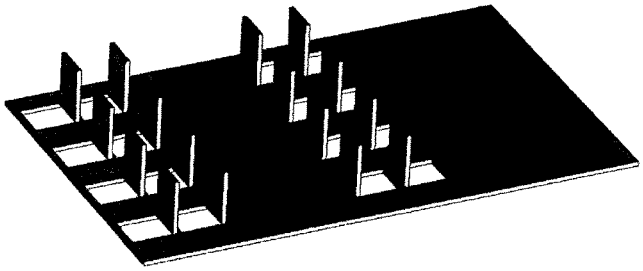
Figure 32B:
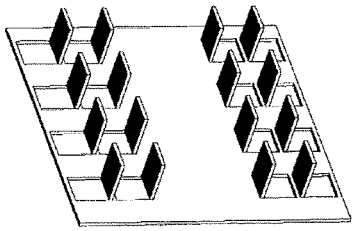
Figure 32D:
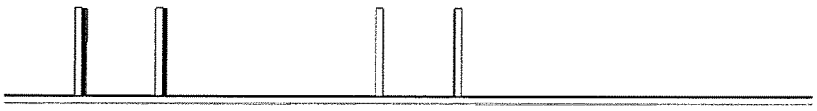

In the embodiments of FIGS. 32*a*-32*d*, the tongues are instead punched out within the perimeter of the base plate, whereby two or more rows of protruding fingers can be obtained in a staggered or non-staggered disposition. In the illustrative examples of FIGS. 32*a*-32*d*, two rows of protruding fingers are provided along each longitudinal side, and in a non-staggered disposition. In the embodiment of FIGS. 32*a* and 32*b*, the base area between the protruding fingers may serve as a lifting area when using pick-and-place assembling. However, for some applications, the base area between the fingers may be insufficient. For example, the base area may have too limited dimensions for certain pick-and-place equipment, the wave guide element may need a more stable base, etc. To this end, the base area may extend past one or both the rows of protruding fingers, to form an additional base area. Such an embodiment, where the base extends past the rows of protruding fingers are one side, is illustrated in FIGS. 32*c* and 32*d*.

Such additional base areas on one or several sides may naturally be used on any of type of wave guide element, and this concept is not limited to the particular wave guide element of FIGS. 32*a*-32*d*.

The waveguide elements discussed so far have protruding fingers distributed relatively evenly along the sides. However, other configurations are also feasible. For example, the protruding fingers may be arranged only at the ends of the waveguide element, as in the embodiment illustrated schematically in FIG. 33. However, many other configurations are also feasible.

Further, the waveguide elements may comprise a combination of protruding fingers being provided as tongues extending from the edges, and tongues being punched out within the base plate. Further, small waveguide elements, each having a relatively simple configuration, may be assembled together to form more complex geometries.

Figure 33:
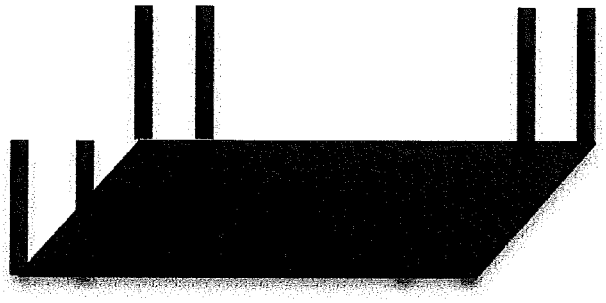
FIGS. 33-35 are schematic illustrations of how different waveguide elements may be combined into more complex waveguide parts.
Figure 34:
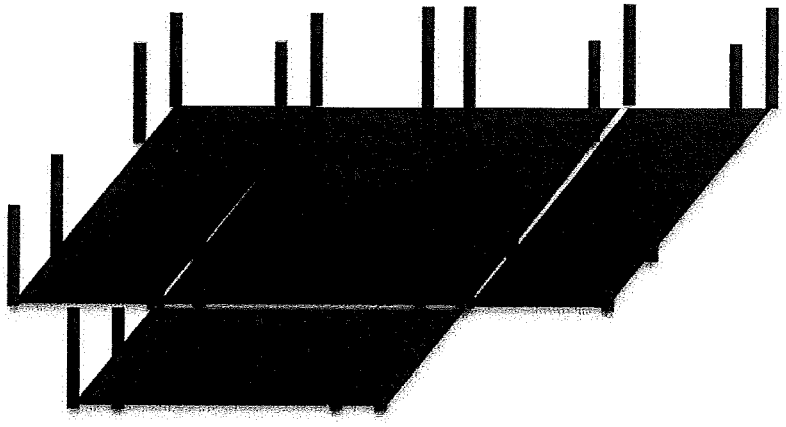

As an example, FIG. 34 is an illustration of a T power divider having three ports, wherein each port is formed by a waveguide element of the type discussed in relation to FIG. 33, and a centre waveguide element is formed by a combination of internal and external protruding fingers.

Figure 35:
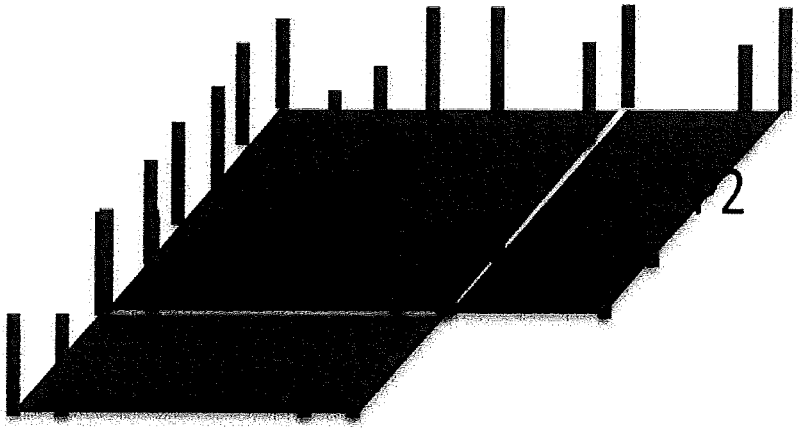

As another example, FIG. 35 is an illustration of a right angle corner, having two ports, each formed by a waveguide element of the type discussed in relation to FIG. 33, and a centre waveguide element formed by a combination of internal and external protruding fingers.

The above two embodiments are merely examples, and other and even more complex geometries can be obtained in the same way. For example, special antenna exciter components to be located below coupling slots can be obtained in the same way.

So far, various examples of waveguide elements primarily intended for groove gap waveguides have been discussed.

However, by placing such waveguide elements around a ridge, or by providing a ridge on the base of these elements, most of these waveguide elements can also be used for forming ridge gap waveguides. Further, many other examples of waveguide elements for forming ridge gap waveguides are feasible, some of which will be briefly discussed in the following.

Figure 36:
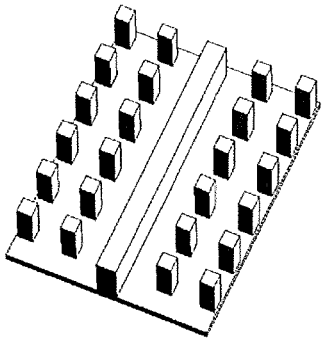
FIGS. 36, 37 and 38 are perspective top views illustrating embodiments of waveguide elements having a solid ridge, for forming ridge gap waveguides.

In FIG. 36, a simple waveguide forming element for forming a straight section of a ridge waveguide is illustrated. The waveguide element comprises a base 161 and protruding fingers 3, such as pins, pillars or the like. Further, a ridge 107 is provided, along which waves can propagate. The ridge is here a solid ridge. Elements such as this can e.g. be produced by etching, spark erosion, molding, such as injection molding, and the like. The waveguide element can either be made of metal, or be provided with a metalized, conducting surface.

This type of ridge elements can be picked and placed in a similar way as discussed above, by using e.g. the upper surface of the ridge as a lifting surface for picking the elements, e.g. by means of pneumatic suction cups.

Figure 37:
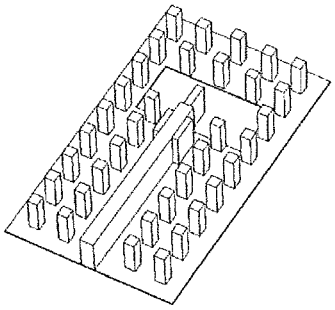

However, the ridge need not be solid. An example of such a waveguide element, resembling the element of FIG. 36, is illustrated schematically in the cross-sectional view of FIG. 37. Here, the waveguide element is formed in a similar way as the embodiments of FIG. 31, with double rows of protruding fingers, formed as bent up tongues, along each longitudinal side. However, contrary to the embodiment of FIG. 31, the base is here formed in a bent shape, to form a rectangular shaped ridge along the centre of the base. The ridge hereby is provided with solid side walls and upper surface, but is unfilled in the middle.

Figure 38:
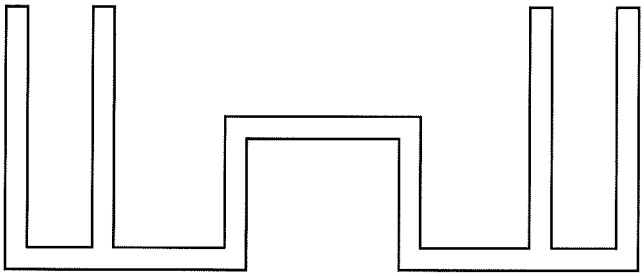
Figure 39:
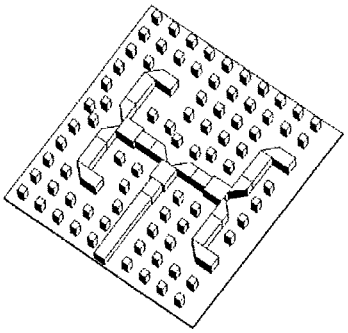
FIG. 39 is a schematic cross-sectional view of a waveguide elements similar to the one in FIG. 31, but having the base formed into a non-solid ridge.

The embodiment of FIG. 38 is similar to the embodiment of FIG. 36, but comprises a somewhat more complex form, having a central ridge extending from one side and into an opening, functioning as a coupling port, in the substrate. The ridge is here preferably provided with a non-uniform width, thereby forming a transition towards the coupling opening. This element may be used as an input or output port of a ridge gap waveguide The embodiment of FIG. 39 is a branched distribution network formed in ridge gap waveguide technology in accordance with [13]. The ridge structure forms a branched so-called corporate distribution network from one input port to four output ports. The distribution network may be much larger than this with many more output ports to feed a larger array. In contrast to the antenna of [13], the stopping texture is here formed as protruding elements/fingers. The ridge is preferably a solid ridge such as shown in the ridge gap waveguides in e.g. [4].

Some examples of waveguide elements have now been discussed. However, it should be acknowledged by the skilled addressee that many other embodiments and variations are feasible. Hereby, a range of standardized waveguide elements can be provided, and used for formation of whole or parts of essentially any type of waveguide or RF part. Since standardized elements may be used, and picked and placed by e.g. ordinary pick and place equipment, waveguides and RF parts can hereby be manufactured very cost-effectively, both in small and large series. The RF parts can even be custom made in a quick and cost-effective way.

Some examples of RF parts have been discussed in the following. However, many other types of per se known RF parts can be produced by using waveguide elements in the above-discussed way. For example, a circular cavity of a rectangular waveguide can be formed in this way, e.g. using curved waveguide elements, so that the protruding fingers/elements are arranged along a circular path, enclosing a circular cavity. Further, in such an embodiment, a feeding arrangement may be provided within the cavity, as well as a radiating opening, such as a X-shaped radiating slot opening.

It is also possible to produce RF parts to form flat array antennas with this technology. For example, antennas structurally and functionally resembling the antenna disclosed in [12] and/or the antenna discussed in [13] can be cost-effectively produced in this way, said documents hereby being incorporated in its entirety by reference. One or several of the waveguide layers of such an antenna may be made as a waveguide as discussed in the foregoing, without any substrate between the two metal ground planes, and with protruding fingers/elements extending between the two conducting layers, formed by waveguide elements with bases attached to the substrate. Then, the conventional via holes, as discussed in [13], will instead be fingers, such as metal pins or the like, forming a waveguide cavity between the two metal plates, within each unit cell of the whole antenna array.

The RF part may also be a gap waveguide filter, structurally and functionally similar to the one disclosed in [14], said document hereby being incorporated in its entirety by reference. However, contrary to the waveguide filter disclosed in this document, the protruding fingers/elements are now then arranged on a lower conducting layer by use of the above-discussed waveguide elements. Another example of a waveguide filter producible in this way is the filter disclosed in [15], said document hereby being incorporated in its entirety by reference.

The RF part may also be used to form a connection to and from an integrated circuit, and in particular MMICs, such as MMIC amplifier modules. Such an embodiment is illustrated schematically in FIG. 40. Here, an integrated circuit is arranged on a substrate, such as a PCB. Waveguide elements, as discussed in the foregoing, may then be placed to form waveguides leading to/from the integrated circuit, and to form a transition between the waveguide and the integrated circuit. In the illustrative example, a MMIC 181 is connected to waveguide elements 182 by a transition element 183. A lid may be arranged on top of the substrate, to form the upper conductive surface of the waveguides.

Figure 41:
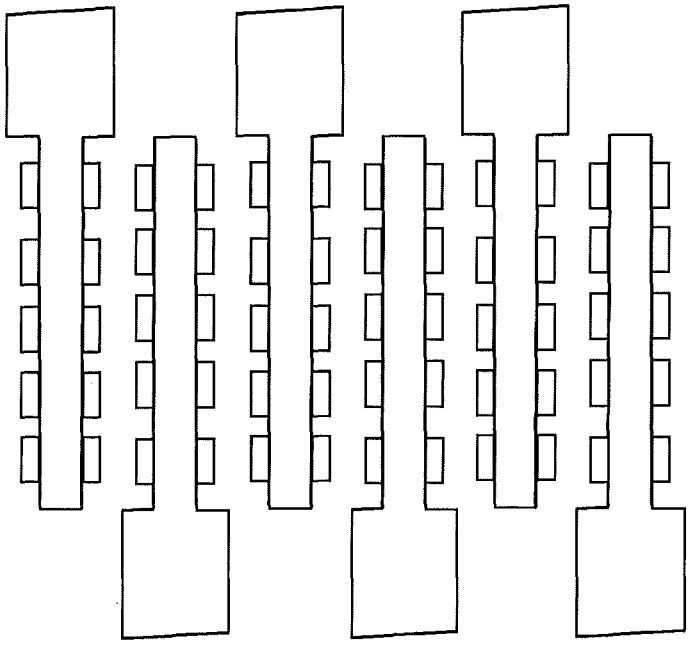
FIG. 41 is a schematic top-view illustrating the use of waveguide elements to form a grid of protruding fingers

Further, grids of protruding fingers may also be provided by waveguide elements of the general type discussed above, for use e.g. for packaging. Such grids may e.g. be formed by providing waveguide elements having one, two or more rows of protruding fingers side-by-side on a substrate. Such an embodiment is illustrated schematically in FIG. 41. In case the rows of the grid are so closely arranged that there is not sufficient space left for pneumatically lifting the waveguide elements, an extension of the base plate may extend out on one of the sides, to function as a lifting area, as schematically illustrated in FIG. 41.

Figure 42A:
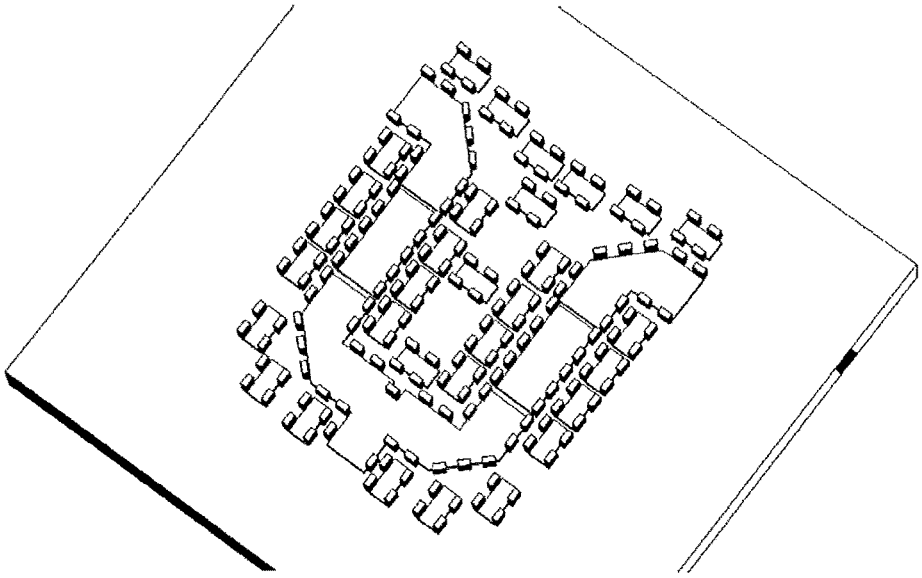
FIGS. 42*a* and 42*b* illustrate an embodiment of a passive network.
Figure 42B:
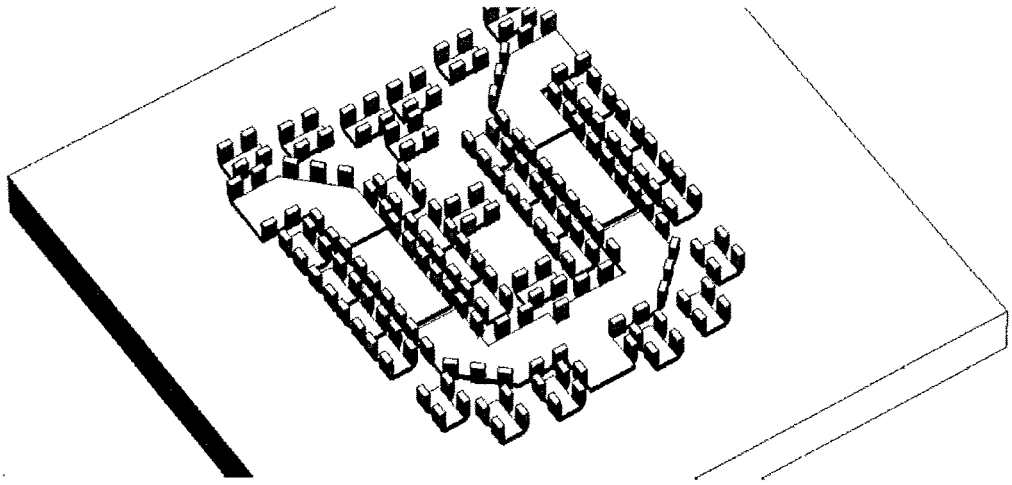

FIGS. 42*a* and 42*b* illustrate two different perspective views of a passive network comprising a branched waveguide, and provide an example of how various types of waveguide elements can be combined to produce more complex realizations. In the illustrative example of FIGS. 42*a* and 42*b*, the waveguide network comprises a branched waveguide element similar to the one of FIG. 26, followed by straight waveguide elements, similar to the one of FIG. 24, and subsequently followed by curved waveguide elements, similar to the one of FIG. 23. In addition, a plurality of smaller waveguide elements, similar to the ones of FIG. 25 are arranged around the perimeter of the waveguide, to provide additional protruding fingers outside the first row of protruding fingers provided by the above-discussed waveguide elements. Hereby, each waveguide section is provided with two or more rows of protruding fingers at each side at all, or at least most, positions.

Figure 40:
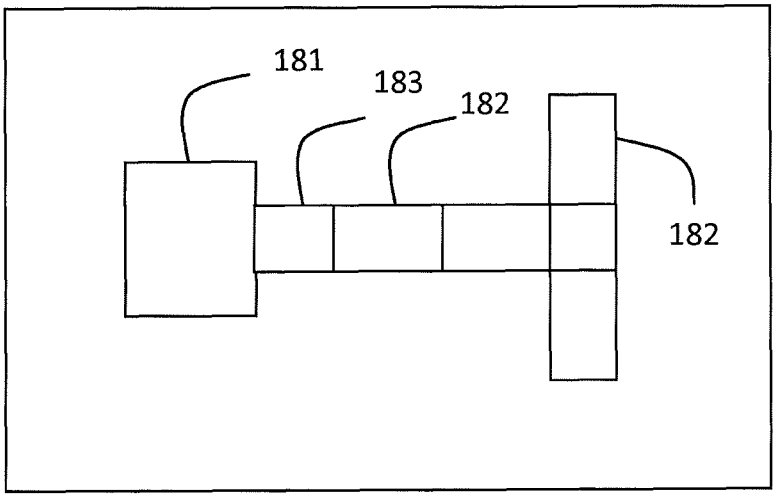
FIG. 40 is a schematic top-view illustrating use of waveguide elements to connect to an integrated circuit.
Figure 43A:
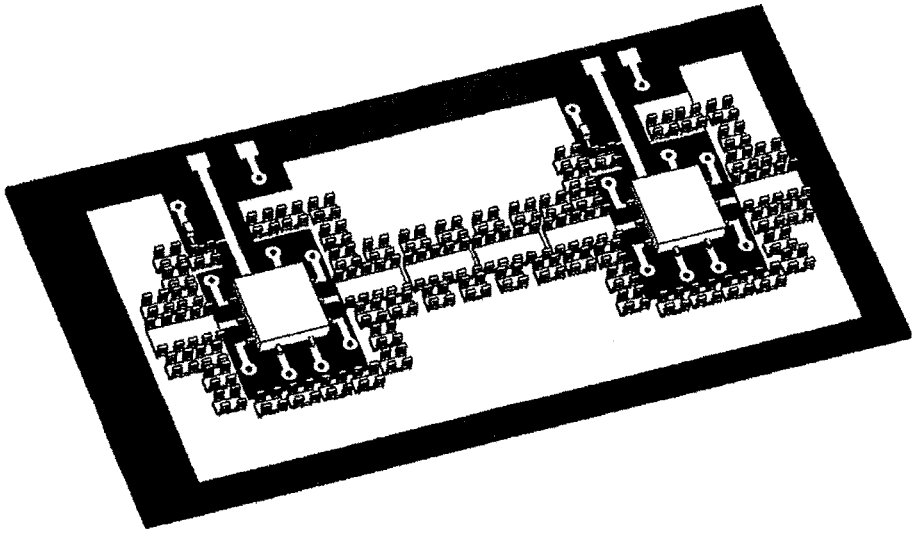
FIGS. 43*a* and 43*b* illustrate an embodiment of a realization with active components.
Figure 43B:
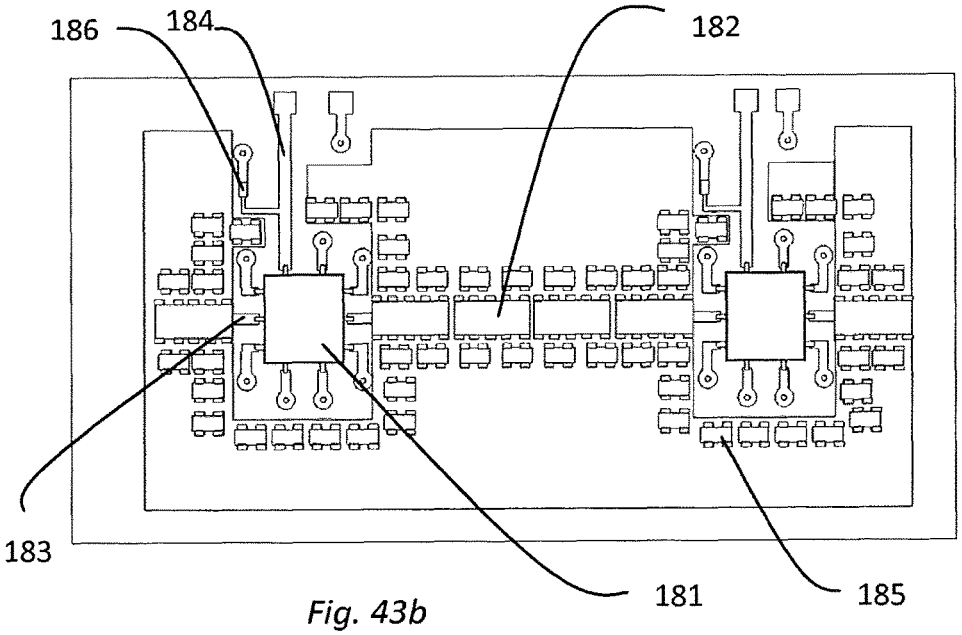

FIGS. 43*a* and 43*b* illustrate examples of an active component, similar to the embodiment of FIG. 40, but illustrated in greater detail. In this embodiment, two active components 181', such as MMICs, are provided. The active components 181' are at the input/output ports connected to a plurality of input/output lines, such as microstrip lines 184 for providing bias voltages to the MMIC. Further, some RF input/output ports are connected to gap waveguide transmission lines, via transition elements 183'. The gap waveguides are here illustrated as straight waveguides, being formed e.g. by elements similar to the one discussed in relation to FIGS. 20 and 24. However, more complex waveguide transmission lines or networks may also be used. Further, a plurality of smaller waveguide elements, here of the type illustrated in FIG. 25, are provided around both the gap waveguides and the active components, to improve the performance of the gap waveguides and provide shielding between the components. In addition, further elements, such as passive components 186 and the like may be provided.

Both the passive network illustrated in FIGS. 42*a* and 42*b* and the active component network of FIGS. 43*a* and 43*b* are merely examples, and the skilled reader will appreciate that other realizations are also feasible in a similar way, to obtain the same or other functionality.

The invention has now been described with reference to specific embodiments. However, several variations of the technology of the waveguide and RF packaging in the antenna system are feasible. For example, a multitude of different waveguide elements useable to form various types of waveguides and other RF parts are feasible, either for use as standardized elements, or for dedicated purposes or even being customized for certain uses and applications. Further, even though assembly by means of pick-and-place equipment is preferred, other types of surface mount technology placement may also be used, and the waveguide elements may also be assembled in other ways. Further, the here disclosed realization of protruding elements can be used in many other antenna systems and apparatuses in which conventional gap waveguides have been used or could be contemplated. Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

REFERENCES

[1]J. Hirokawa and M. Ando, "Efficiency of 76-GHz post-wall waveguide-fed parallel-plate slot arrays," *IEEE Trans. Antenna Propag.*, vol. 48, no. 11, pp. 1742-1745, November 2000.

[2] Per-Simon Kildal, "Waveguides and transmission lines in gaps between parallel conducting surfaces", patent application No. PCT/EP2009/057743, 22 Jun. 2009.

[3] P.-S. Kildal, E. Alfonso, A. Valero-Nogueira, E. Rajo-Iglesias, "Local metamaterial-based waveguides in gaps between parallel metal plates," *IEEE Antennas and Wireless Propagation letters*, vol. 8, pp. 84-87, 2009.

[4] P.-S. Kildal, A. Uz Zaman, E. Rajo-Iglesias, E. Alfonso and A. Valero-Nogueira, "Design and experimental verification of ridge gap waveguides in bed of nails for parallel plate mode suppression," *IET Microwaves, Antennas & Propagation*, vol. 5, iss. 3, pp. 262-270, March 2011.

[5] E. Rajo-Iglesias, P.-S. Kildal, "Numerical studies of bandwidth of parallel plate cut-off realized by bed of nails, corrugations and mushroom-type EBG for use in gap waveguides," *IET Microwaves, Antennas & Propagation*, vol. 5, no. 3, pp. 282-289, March 2011.

[6] P.-S. Kildal, "Three metamaterial-based gap waveguides between parallel metal plates for mm/submm waves", 3rd *European Conference on Antennas and Propagation*, Berlin, March 2009.

[7] E. Rajo-Iglesias, P.-S. Kildal, "Numerical studies of bandwidth of parallel plate cut-off realized by bed of nails, corrugations and mushroom-type EBG for use in gap waveguides," *IET Microwaves, Antennas & Propagation*, vol. 5, no. 3, pp. 282-289, March 2011.

[8] A. Valero-Nogueira, J. Domenech, M. Baquero, J. I. Herranz, E. Alfonso, and A. Vila, "Gap waveguides using a suspended strip on a bed of nails," *IEEE Antennas and Wireless Propag. Letters*, vol. 10, pp. 1006-1009, 2011.

[9] E. Pucci, E. Rajo-Iglesias, P.-S. Kildal, "New Microstrip Gap Waveguide on Mushroom-Type EBG for Packaging of Microwave Components", IEEE Microwave and Wireless Components Letters, Vol. 22, No. 3, pp. 129-131, March 2012.

[10] E. Pucci, E. Rajo-Iglesias, J.-L. Vasquuez-Roy, P.-S. Kildal, "Planar Dual-Mode Horn Array with Corporate-Feed Network in Inverted Microstrip Gap Waveguide", accepted for publication in IEEE Transactions on Antennas and Propagation, March 2014.

[11] E. Pucci, A. U. Zaman, E. Rajo-Iglesias, P.-S. Kildal, "New low loss inverted microstrip line using gap waveguide technology for slot antenna applications", 6th European Conference on Antennas and Propagation EuCAP 2011, Rome, 11-15 Apr. 2011.

[12] E. Pucci, E. Rajo-Iglesias, J.-L. Vazquez-Roy and P.-S. Kildal, "Design of a four-element horn antenna array fed by inverted microstrip gap waveguide", 2013 IEEE International Symposium on Antennas and Propagation (IEEE AP-S 2013), Orlando, USA, Jul. 7-12, 2013.

[13] Seyed Ali Razavi , Per-Simon Kildal, Liangliang Xiang, Haiguang Chen, Esperanza Alfonso, "Design of 60 GHz Planar Array Antennas Using PCB-based Microstrip-Ridge Gap Waveguide and SIW", 8th European Conference on Antennas and Propagation EuCAP 2014, The Hague, The Netherlands, 6-11 Apr. 2014.

[14] A. U. Zaman, A. Kishk, and P.-S. Kildal, "Narrow-band microwave filter using high Q groove gap waveguide resonators without sidewalls", IEEE Transactions on Components, Packaging and Manufacturing Technology, Vol. 2, No. 11, pp. 1882-1889, November 2012.

[15] A. Algaba Brazález, A. Uz Zaman, P.-S. Kildal, "Improved Microstrip Filters Using PMC Packaging by Lid of Nails", IEEE Transactions on Components, Packaging and Manufacturing Technology, Vol. 2, No. 7, July 2012.

[16] A.U. Zaman, T. Vukusic, M. Alexanderson, P.-S. Kildal, "Gap Waveguide PMC Packaging for Improved Isolation of Circuit Components in High Frequency Microwave Modules", IEEE Transactions on Components, Packaging and Manufacturing Technology, Vol. 4, Issue 1, p. 16-25, 2014.

The invention claimed is:

1. A microwave device, such as a waveguide, transmission line, waveguide circuit, transmission line circuit or radio frequency part of an antenna system, the microwave device comprising two conducting layers arranged with a gap there between, and a set of periodically or quasi-periodically arranged protruding elements fixedly connected to at least one of said conducting layers, thereby forming a texture to stop wave propagation in a frequency band of operation in other directions than along intended waveguiding paths, all protruding elements being connected electrically to each other at their bases at least via said conductive layer on which they are fixedly connected, and wherein some or all of the protruding elements are in conductive contact and/or non-conductive contact also with the other conducting layer.

2. The microwave device of claim 1, wherein at least one of the conductive layers is further provided with at least one conducting element, said conducting element not being in electrical contact with the other of said two conducting layers, said conducting element(s) thereby forming said waveguiding paths, preferably for a single-mode wave.

3. The microwave device of claim 2, wherein the conducting element(s) is one of a conducting ridge and a groove with conducting walls.

4. The microwave device of claim 3, wherein the protruding elements in contact with the other conducting layer are preferably fixedly connected to the other conducting layer, and wherein the protruding elements are arranged to at least partly surround a cavity between said conducting layers, said cavity thereby forming said groove functioning as a waveguide.

5. The microwave device of claim 2, wherein the width of the conducting element is in the range 1.0 - 6.0 mm, and preferably in the range 2.0- 4.0 mm.

6. The microwave device of claim 1, wherein the microwave device is a radio frequency (RF) part of an antenna system, e.g. for use in communication, radar or sensor applications.

7. The microwave device of claim 1, wherein the distance between adjacent protruding elements in the set of periodically or quasi-periodically arranged protruding elements is in the range of 0.05 - 2.0 mm, and preferably in the range 0.1-1.0 mm.

8. The microwave device of claim 1, wherein each of the protruding elements have a maximum width dimension in the range 0.05 - 1.0 mm, and preferably in the range 0.1 - 0.5 mm.

9. The microwave device of claim 1, wherein at least some, and preferably all, of the protruding elements are in mechanical contact with said other conducting layer.

10. The microwave device of claim 9, wherein at least some of said protruding elements are fixedly attached to said other conducting layer, e.g. by means of soldering or adhesion.

11. The microwave device of claim 1, wherein said protruding elements have essentially identical heights, the maximum height difference between any pair of protruding elements being less than 0.02 mm, and preferably being less than 0.01 mm.

12. The microwave device according to claim 1, wherein the two conducting layers are connected together for rigidity by a mechanical structure at some distance outside the region with guided waves, where the mechanical structure may be integrally and preferably monolithically formed on at least one of the conducting materials defining one of the conducting layers.

13. The microwave device according to claim 1, wherein at least part of the two conducting layers are mostly planar except for the fine structure provided by the ridges, grooves and texture.

14. The microwave device according to claim 1, wherein the set of periodically or quasi-periodically arranged protruding elements are monolithically formed on one of said conducting layers, and preferably monolithically formed by coining, whereby each protruding element is monolithically fixed to the conducting layer, all protruding elements being connected electrically to each other at their bases via said conductive layer on which they are fixedly connected.

15. The microwave device according to claim 14, further comprising at least one ridge along which waves are to propagate, said ridge being arranged on the same conducting layer as the protruding elements, and also being monolithically formed on said conducting layer.

16. The microwave device of claim 1, further comprising a plurality of monolithic waveguide elements, each having a base and protruding fingers extending up from the base, thereby forming said protruding elements, wherein the waveguide elements are conductively connected with one of said conducting layers, and arranged to form a waveguide along this conducting layer.

17. The microwave device of claim 16, wherein the waveguide elements comprises flat base plates for formation of groove gap waveguides.

18. The microwave device of claim 16, wherein the waveguide elements comprises bases provided with protruding ridges, for formation of ridge gap waveguides.

19. The microwave device of claim 16, wherein the waveguide elements are made of metal.

20. The microwave device of claim 16, wherein at least one of the waveguide elements comprises a plurality of fingers arranged on two opposite sides of the base.

21. The microwave device of claim 16, wherein at least one of the waveguide elements comprises a plurality of fingers arranged along two or more parallel but separate lines along at least one of the edges.

22. The microwave device of claim 16, wherein at least one of the waveguide elements comprises a plurality of fingers arranged along a single line along at least one of the edges.

23. The microwave device of claim 16, wherein at least some of the fingers are bent-up tongues extending from the outer side of the base.

24. The microwave device of claim 16, wherein at least some of the fingers are bent-up tongues extending from interior cut-outs within the base.

25. The microwave device of claim 16, wherein the waveguide elements comprises at least one of a straight waveguide element, a curved or bent waveguide element, a branched waveguide element and a transition waveguide element.

26. The microwave device of claim 16, wherein the transition waveguide element is a transition to connect to a monolithic microwave integrated circuit module (MMIC).

27. The microwave device of claim 16, wherein the protruding height of the fingers is greater than the width and thickness of the fingers, and preferably greater than double the width and thickness.

28. The microwave device of claim 16, wherein the width of the fingers is greater than the thickness.

29. The microwave device of claim 1, wherein said protruding elements are formed as a surface mount technology grid array, such as a pin grid array, column grid array and/or a ball grid array, wherein each pin is fixed to the conducting layer by soldering, but wherein all protruding elements are connected electrically to each other at their bases via said conductive layer on which they are fixedly connected.

30. The microwave device of claim 29, further comprising a ball grid array arranged outside the protruding elements forming said texture to stop wave propagation, said ball grid array functioning as spacers between said conducting layers.

31. The microwave device according to claim 1, wherein the protruding elements have maximum cross-sectional dimensions of less than half a wavelength in air at the operating frequency, and/or wherein the protruding elements in the texture stopping wave propagation are spaced apart by a spacing being smaller than half a wavelength in air at the operating frequency.

32. The microwave device according to claim 1, wherein at least one of the conducting layers is provided with at least one opening, preferably in the form of rectangular slot(s), said opening(s) allowing radiation to be transmitted to and/or received from said microwave device.

33. The microwave device according to claim 1, further comprising at least one integrated circuit module, such as a monolithic microwave integrated circuit module, arranged between said conducting layers, the texture to stop wave propagation thereby functioning as a means of removing resonances within the package for said integrated circuit module(s).

34. The microwave device of claim 33, wherein the integrated circuit module(s) is arranged on one of said conducting layer, and wherein protruding elements overlying the integrated circuit(s) are shorter than protruding elements not overlying said integrated circuit(s).

35. The microwave device of claim 1, wherein the microwave device is adapted to form waveguides for frequencies exceeding 20 GHz, and preferably exceeding 30 GHz, and most preferably exceeding 60 GHz.

36. A flat array antenna comprising a corporate distribution network realized by a microwave device of claim 1.

37. A method for producing a microwave device, such as a waveguide, transmission line, waveguide circuit, transmission line circuit or radio frequency part of an antenna system, the method comprising:

providing a conducting layer having a set of periodically or quasi-periodically arranged protruding elements fixedly connected thereto, all protruding elements being connected electrically to each other at their bases at least via said conductive layer on which they are fixedly connected;

arranging another conducting layer over said conducting layer, thereby enclosing the protruding elements within the gap formed between the conducting layers;

wherein protruding elements form a texture to stop wave propagation in a frequency band of operation in other directions than along intended waveguiding paths, and wherein some or all of the protruding elements are in conductive or non-conductive contact also with the other conducting layer.

38. The method of claim 37, wherein the step of providing a conducting layer having a set of periodically or quasi-periodically arranged protruding elements fixedly connected thereto comprises:

providing a die being provided with a plurality of recessions forming the negative of the protruding elements;

arranging a formable piece of material on the die; and applying a pressure on the formable piece of material, thereby compressing the formable piece of material to conform with the recessions of the die.

39. The method of claim 38, wherein the die is provided with a collar in which the formable piece of material is insertable.

40. The method of claim 39, wherein the die comprises a base plate and a collar, the collar being provided as a separate element, loosely arranged on the base plate.

41. The method of claim 38, wherein the die further comprises at least one die layer comprising through-holes forming said recessions.

42. The method of claim 41, wherein the die comprises at least two sandwiched die layers comprising through-holes.

43. The method of claim 41, wherein the at least one die layer is arranged within the collar.

44. The method of claim 37, wherein the step of providing a conducting layer having a set of periodically or quasi-periodically arranged protruding elements fixedly connected thereto comprises:

providing a first conducting layer, e.g. arranged as a metalized layer on a substrate;

providing a plurality of monolithic waveguide elements, each having a base and protruding fingers extending up from the base; and conductively connecting the waveguide elements with the first conducting layer, and arranged to form a waveguide along the first conducting layer.

45. The method of claim 44, wherein the step of conductively connecting the waveguide elements with the first conducting layer is made by pick-and-place technology.

46. The method of claim 44, wherein the step of conductively connecting the waveguide elements with the first conducting layer comprises the sub-steps of:

picking and placing waveguide elements with a vacuum placement system on said first conducting layer, so that the waveguide elements becomes adhered to the first conducting layer; and heating the substrate at an elevated temperature, thereby connecting the waveguide elements to the first conducting layer by means of soldering.

47. The method of claim 37, wherein the step of providing a conducting layer having a set of periodically or quasi-periodically arranged protruding elements fixedly connected thereto comprises:

providing a first conducting layer; and fixedly connecting a set of periodically or quasi-periodically arranged protruding elements to the first conducting layer, wherein said protruding elements are all electrically connected to each other via said conducting layer on which they are fixedly connected, and wherein said protruding elements are formed by surface mount technology grid array, such as a pin grid array, column grid array and/or ball grid array technology.

48. The method of claim 47, wherein the step of providing protruding elements on the first conducting layer involves the steps of:

producing a pattern of the layout of the protruding elements and possible waveguide paths on the first conducting layer;

arranging the parts to be connected to the first conducting layer in a jig; and connecting the parts to the first conducting layer.

* * * * *